US011959351B2

(12) United States Patent
Andueza et al.

(10) Patent No.: US 11,959,351 B2
(45) Date of Patent: Apr. 16, 2024

(54) WELLHEAD CONNECTING ASSEMBLY

(71) Applicant: FMC Technologies, Inc., Houston, TX (US)

(72) Inventors: Alejandro Andueza, Rio de Janeiro (BR); Barry Stewart, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 105 days.

(21) Appl. No.: 17/755,195

(22) PCT Filed: Nov. 6, 2019

(86) PCT No.: PCT/US2019/060116
§ 371 (c)(1),
(2) Date: Apr. 22, 2022

(87) PCT Pub. No.: WO2021/091554
PCT Pub. Date: May 14, 2021

(65) Prior Publication Data

US 2022/0372828 A1 Nov. 24, 2022

(51) Int. Cl.
*E21B 33/03* (2006.01)
*E21B 17/08* (2006.01)
*E21B 33/038* (2006.01)

(52) U.S. Cl.
CPC ..... *E21B 33/038* (2013.01); *E21B 17/085* (2013.01)

(58) Field of Classification Search
CPC .. E21B 17/085; E21B 17/0853; E21B 33/038; E21B 43/013
See application file for complete search history.

(56) References Cited

U.S. PATENT DOCUMENTS 3,096,999 A 7/1963 Ahlstone et al.
4,516,795 A 5/1985 Baugh
(Continued)

FOREIGN PATENT DOCUMENTS

GB 2129895 A 5/1984
WO 2017105427 A1 6/2017

OTHER PUBLICATIONS

International Search Report issued in International Application No. PCT/US2019/060166 dated Jul. 13, 2020 (4 pages).
(Continued)

*Primary Examiner* — Tara Schimpf
*Assistant Examiner* — Lamia Quaim
(74) *Attorney, Agent, or Firm* — Osha Bergman Watanabe & Burton LLP

(57) ABSTRACT

A connecting assembly for connecting a first body and a second body includes a connector having a plurality of segments and a main piston positioned around at least a portion of the connector. The connector includes: a channel that extends longitudinally through the connector from a first end to a second end; a plurality of teeth formed on an inside of the connector near the first end and near the second end; a first jaw formed of at least one teeth near the first end; and a second jaw formed of at least one teeth near the second end and axially spaced apart from the first jaw. Each of the plurality of teeth has a leading side facing an axial center of the connector, a top side, a contact point at a transition between the leading side and the top side, and a trailing side opposite the leading side. The teeth of the second jaw include: a first tooth axially closer to the axial center of the connector than the remaining teeth of the second jaw and an end tooth axially farther from the axial center of the connector than the remaining teeth of the second jaw.

18 Claims, 17 Drawing Sheets

(56) References Cited

U.S. PATENT DOCUMENTS

| | | | | |
|---|---|---|---|---|
| 5,971,076 | A | 10/1999 | Taylor et al. | |
| 7,614,453 | B2 | 11/2009 | Spiering et al. | |
| 2003/0151254 | A1 | 8/2003 | Baugh | |
| 2007/0277983 | A1* | 12/2007 | Spiering | E21B 33/038 166/338 |

OTHER PUBLICATIONS

Written Opinion issued in International Application No. PCT/US2019/060166 dated Jul. 13, 2020 (7 pages).

* cited by examiner

WELLHEAD CONNECTING ASSEMBLY

BACKGROUND

Field of the Disclosure

The present invention relates to a connector which features teeth that aide in catching and connecting two bodies.

Background Art

Subsea hydraulic connectors may be used to make a rigid and sealed connection between two pieces of equipment. Such connectors are commonly used in the area of oil and gas, for interfacing of Christmas Trees (XTs), Lower Riser Packages (LRPs), Tubing Heads (THs) and Wellheads (WHDs).

Subsea hydraulic connectors may be locked by driving a hydraulic piston around connecting segments, which engage with locking profiles in the equipment being connected. For example, a hydraulic connector may include an annular main body that is aligned and connected axially to a subsea wellhead. To form the connection, the connector typically has multiple connecting segments that move radially when a hydraulic actuator, often a hydraulically-driven piston, moves axially along the length of the connecting segments. This radial movement of the segments puts the connector in a locked or an unlocked position.

Subsea connectors used to connect two mating components may include a gasket between the components to form a gas or liquid tight seal. The connectors introduce a preload into the connection by using hydraulic pressure to drive the connecting segments into a mating locking profile on the components being connected. This preload may energize the gasket to provide high contact stresses between sealing profiles to resist fluid or gas penetration.

The earliest wellhead connectors consisted of a clamp, generally in a "C" shape, with a single contact surface. U.S. Pat. No. 3,096,999 describes a connector with a single contact surface profile.

Later, connectors with multiple teeth were designed to better distribute the stress when compared to ones with a single surface. U.S. Pat. No. 7,614,453 depicts a connector with a multi-tooth profile where the load is distributed through the profile.

SUMMARY

According to one or more embodiments, a connecting assembly for connecting a first body and a second body includes a connector having a plurality of segments and a main piston positioned around at least a portion of the connector. The connector includes: a channel that extends longitudinally through the connector from a first end to a second end; a plurality of teeth formed on an inside of the connector near the first end and near the second end; a first jaw formed of at least one teeth near the first end; and a second jaw formed of at least one teeth near the second end and axially spaced apart from the first jaw. Each of the plurality of teeth has a leading side facing an axial center of the connector, a top side, a contact point at a transition between the leading side and the top side, and a trailing side opposite the leading side. The teeth of the second jaw include: a first tooth axially closer to the axial center of the connector than the remaining teeth of the second jaw and an end tooth axially farther from the axial center of the connector than the remaining teeth of the second jaw. Additionally, if the second jaw only has one tooth, the first tooth may also be the end tooth. The leading side of the first tooth may include an altered surface, an engagement surface, and an edge point at a transition between the altered surface and the engagement surface. When the main piston is in an unlocked position, at least one of the first or second ends of the connector may be in a disconnected position. When the main piston is in a locked position, both the first end and the second end of the connector may be in a connected position. For each tooth with the altered surface: a contact distance is measured axially between the contact point and the axial center; an edge distance is measured axially between the edge point and the axial center; and an axial contact separation is the contact distance minus the edge distance. For each tooth without an altered surface: the axial contact separation is equal to zero.

According to one or more embodiments, a method for connecting a first body and a second body includes: connecting a connecting assembly (which includes a connector and a main piston) to a first axial end of the first body with a first end of the connector in a connected position (i.e., a first locking profile formed on the first end engaging a first receiving profile formed on the first axial end) and with a second end of the connector in a disconnected position; positioning the first body so the first axial end interfaces a second axial end of the second body and so the second end of the connector is adjacent to the second axial end; translating the main piston from an unlocked position to a locked position so that the second end of the connector converts to the connected position; capturing at least a first groove of a second receiving profile formed on the second axial end with a first tooth of a second locking profile formed on the second end of the connector, the first tooth having a first altered surface formed along a leading side of the first tooth; and holding both the first end and the second end of the connector in the connected position to interlock the first locking profile with the first receiving profile and to interlock the second locking profile with the second receiving profile.

According to one or more embodiments, a connector includes: a plurality of segments arranged in a tubular configuration having a first end and a second end; a first jaw near the first end; and a second jaw near the second end, axially spaced apart from the first jaw. The first jaw includes at least one teeth formed on an inside of the plurality of segments and having a first locking profile. The second jaw includes at least one teeth formed on the inside of the plurality of segments and having a second locking profile. The at least one teeth of the second jaw includes a first tooth axially closer to an axial center of the connector than the remaining teeth of the second jaw and an end tooth axially farther from the axial center of the connector than the remaining teeth of the second jaw. Additionally, if the second jaw only has one tooth, the first tooth may also be the end tooth. The first tooth has a first altered surface formed at a leading side of the first tooth. For each of the teeth having an altered surface: a contact point is at an end of the altered surface farthest from the axial center; an edge point is at an end of the altered surface closest to the axial center; a contact distance is measured between the contact point and the axial center; an edge distance is measured between the edge point and the axial center; and an axial contact separation is equal to the contact distance minus the edge distance. For each of teeth lacking an altered surface: the axial contact separation is equal to zero.

Other aspects and advantages of the invention will be apparent from the following description and the appended claims.

DETAILED DESCRIPTION

Embodiments of the present disclosure may include a subsea connector having segments with an altered tooth locking profile. Connectors disclosed herein may be used to connect two bodies at their axial ends.

Figure 1:
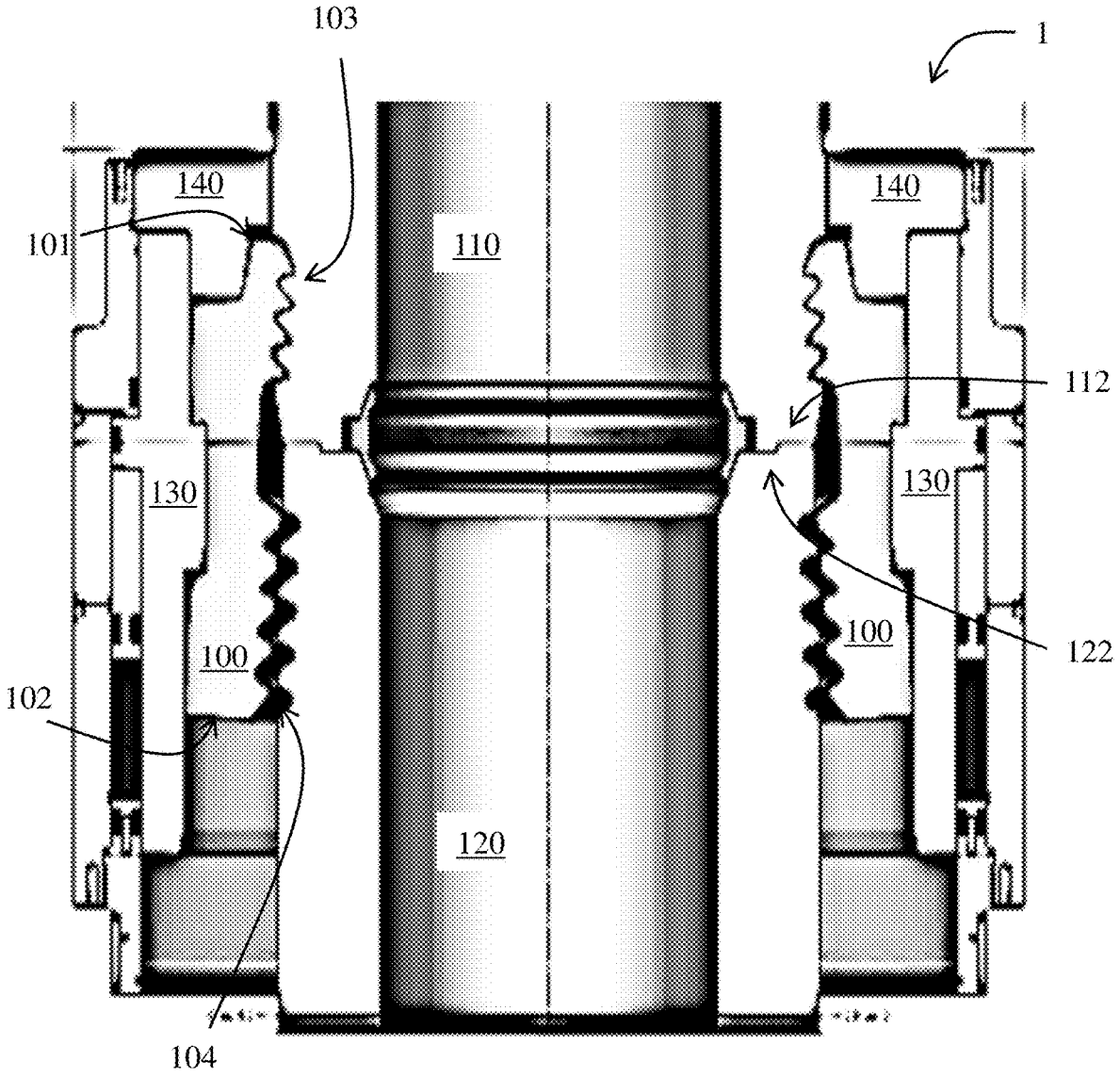
FIG. 1 depicts a connecting assembly in the unlocked configuration according to one or more embodiments.
Figure 2:
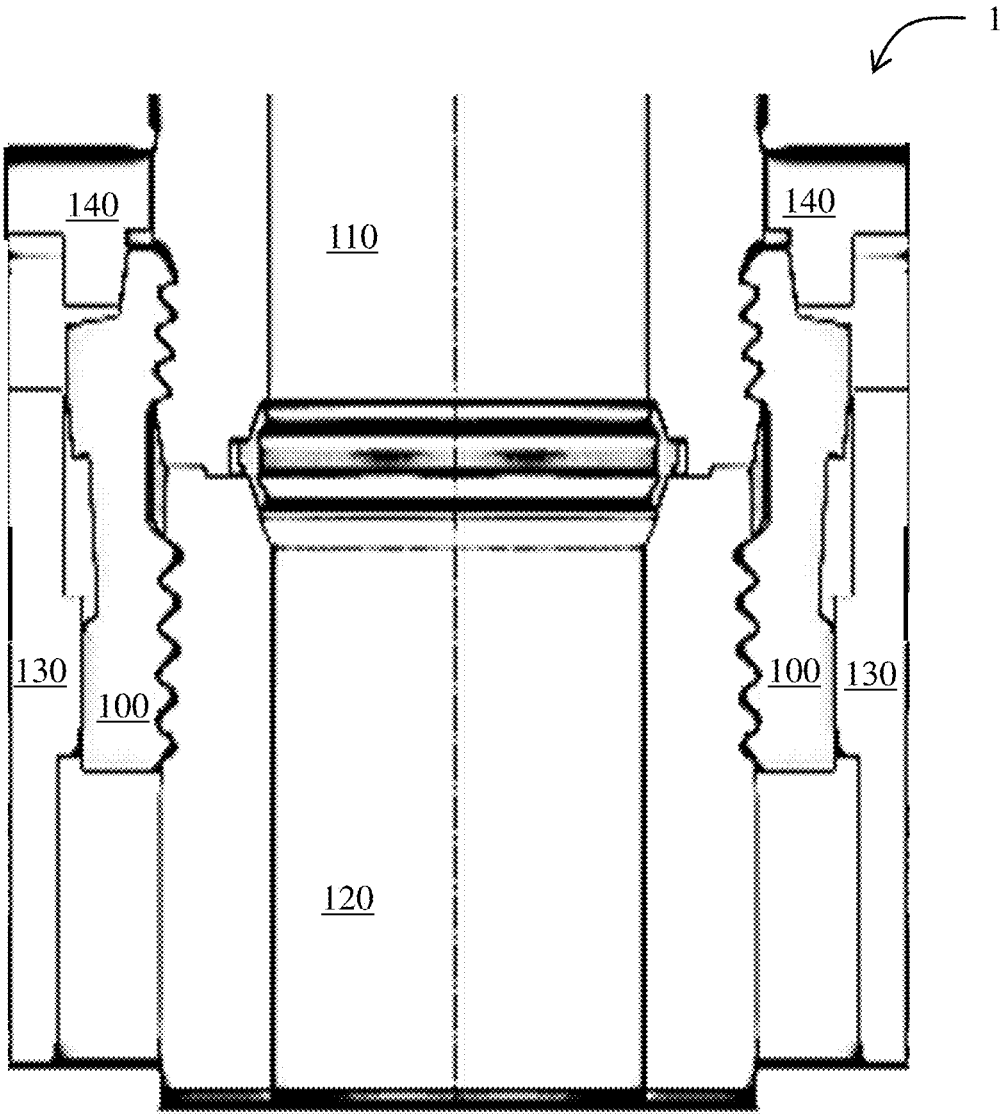
FIG. 2 depicts the connecting assembly shown in FIG. 1 in the locked configuration according to one or more embodiments.

For example, referring collectively to FIGS. 1 and 2, a connecting assembly 1 according to embodiments of the present disclosure including a connector 100 and a main piston 130 may be encompassed around the axial ends of a first body 110 and a second body 120 to connect the axial ends of the bodies together. In the embodiment shown, the bodies 110, 120 are cylindrical fluid conduits, such as piping or tubular components, having a flow path, or channel, therethrough.

The connector 100 includes a channel that extends longitudinally through the connector from a first end 101 to a second end 102; has an inside and an outside; and is able to surround a part of the first body 110 and a part of the second body 120. The connector 100 may be segmented along its length into multiple connecting segments, for example collets, the ends of which are each capable of moving radially. For example, in some embodiments, connecting segments may be formed by first machining a tubular section having the desired shape for connecting two bodies, and then cutting the tubular section axially along its entire length into the connecting segments. Connectors of the present disclosure may be formed of two or more connecting segments, for example, ranging from 2 to 16 connecting segments, or more than 16 connecting segments, depending on, for example, the size and shape of the bodies being connected. The connecting segments may be arranged circumferentially around one or both bodies being connected to form the connector, and the connecting segments may be held in place by one or more rings (e.g., adjustment ring 140).

As shown, a first jaw 103 is formed on the inside of the connector near the first end 101, where the first jaw 103 has a first locking profile (i.e., the cross sectional shape of the first jaw) that corresponds in shape with a first receiving profile on an outside of the first body 110. A second jaw 104 formed on the inside of the connector near the second end 102, axially spaced apart from the first jaw 103, has a second locking profile (i.e., the cross sectional shape of the second jaw) that generally corresponds in shape with a second receiving profile on an outside of the second body 120. The first jaw 103 and second jaw 104 may be formed around the inside of the connector on each of the connecting segments, such that each of the connecting segments may move radially inward (e.g., to engage and lock with a receiving profile) or radially outward.

In the embodiment shown, the first and second receiving profiles of the bodies may each have one or more grooves extending radially around the outside of the bodies to form a generally undulating cross sectional profile. The connector 100 may include one or more ridges or protrusions (which may be described herein as "teeth") extending radially around the inside of the connector 100, where the cross-sectional shape of such ridges form the first and second locking profiles. In some embodiments, one or more of the ridges may have a cross sectional profile of a beveled tooth. When the locking profiles are axially aligned and engaged with the receiving profiles, such as shown in FIG. 2, the locking profiles may fit within the corresponding receiving profiles, even though one or more of the teeth in the first and/or second jaw may have a cross sectional shape that differs from the cross sectional shape of the receiving profile groove in which the tooth fits.

A main piston 130 having a generally tubular body may at least partially surround the outside of the connector 100. According to embodiments of the present disclosure, a flat-to-flat locking mechanism may be used between the main piston and connector. Alternatively, a tapered locking method could be employed between the main piston and the connector. For example, as shown in the embodiment of FIGS. 1 and 2 that employ a flat-to-flat locking mechanism, the cross sectional shapes of the inside of the main piston 130 and the outside of the connector 100 may have corresponding stepped segments parallel with their central axes forming a flat-to-flat locking mechanism. This type of locking method allows preload of the main piston around the connector to be set off-site (e.g., in a factory), and, as the flat-to-flat interface induces no axial force, does not require pressure or any alternative mechanism to keep the connector locked. Other connecting assemblies may use a tapered locking method, where the piston wedges locking segments into a receiving locking profile. A tapered locking method may allow preload to be set in the field by applying different locking hydraulic pressures, but requires a secondary locking mechanism to prevent the axial force from inducing unlocking. Accidental unlocking can also be induced in some connectors by VIV (Vortex Induced Vibrations).

In some embodiments, the piston 130 may be hydraulically actuated to move axially along the outside of the connector. However, other actuation methods, such as manual activation, may be used to move the piston to lock and/or unlock the connector.

As used herein, the axial direction may refer to the direction parallel to the axis of the bodies or the direction parallel to the channel axis through the connector. Therefore, the axial direction may also be parallel to the direction of fluid flow within either body. The radial direction may refer to the direction of the radius of the bodies. Thus, the radial direction and the axial direction are perpendicular.

When the main piston 130 is in an unlocked position, such as shown in FIG. 1, the second end 102 of the connector 100 may be in a radially outward position, while the first end 101 of the connector may be in a radially inward position. In the unlocked configuration, the main piston 130 may, either directly or indirectly, hold the first end 101 of the connector in this radially inward position. In the embodiment depicted in FIGS. 1 and 2, the main piston does not directly hold the first end 101 of the connector in the radially inward position. Instead, the first end is held in the radially inward position by one or more intermediate components, like the adjustment ring 140, that is then held in place by threading around the first body 110, by the main piston 130, or by other means. The second end 102 being in a radially outward position allows the second end of the connector to move into position around the outside of the second body 120 in preparation for transition to the locked configuration. Once moved around the second body, the second jaw 104 is radially outside the second receiving profile in the second body, and the first jaw 103 is in a locking engagement with the first receiving profile of the first body 110. As the connector 100 moves around the second body, parts of the second jaw 104 may be spaced apart from the second receiving profile and parts of the second jaw 104 may be in contact with the second receiving profile. In an alternative embodiment of the connecting assembly, both the first end 101 and the second end 102 of the connector are in a radially outward position when in the unlocked configuration. In this embodiment, movement of the main piston may still radially move the first and second ends, either directly or indirectly. Discussion herein of the main piston causing the connector to engage with the first and second bodies does not imply direct contact of the main piston with one or both ends of the connector. All embodiments described herein may further include one or more intermediate components to transfer the force of the main piston to the first and/or second ends of the connector. In some embodiments, intermediate component(s) may be disposed between the main piston and the first and/or second ends of the connector.

When the main piston 130 is in a locked position, such as shown in FIG. 2, the second end 102 of the connector 100 and the first end 101 of the connector 100 may be in radially inward positions (both radially compressed by the main piston assembly). In such a position, the second jaw 104 is in a locking engagement with the second receiving profile of the second body 120, and the first jaw 103 is in a locking engagement with the first receiving profile of the first body 110. A radially inward position of both the first end and second end of the connector connects the first and second bodies. Thus, the connector connects the first body to the second body by interlocking the first locking profile with the first receiving profile and interlocking the second locking profile with the second receiving profile.

As such, the axial position of the main piston dictates the position of the second end of the connector. Furthermore, axial motion of the main piston moves the second end of the connector between the radially outward position and the radially inward position.

According to embodiments of the present disclosure, axial movement of the main piston 130 may cause the first jaw 103 of the connector 100 to lock with the first receiving profile of the first body 110 prior to aligning the first axial end 112 of the first body 110 with the second axial end 122 of the second body 120. The main piston 130 may directly lock the connector 100 into the first receiving profile of the first body 110, or may indirectly lock the connector 100 into the first receiving profile of the first body 110 through one or more intermediate components, such as the adjustment ring 140 in the embodiment depicted in FIG. 1. The first body 110 and connecting assembly (including the connector 100 and main piston 130) may then be aligned with the second body 120, such that the first axial end 112 of the first body 110 interfaces the second axial end 122 of the second body 120 and the second end 102 of the connector 100 surrounds the second axial end 122 of the second body.

An "interface" between connected first and second bodies is an imaginary plane that extends radially between the axial ends of the first body and the second body, and is perpendicular to the axial direction of the bodies. Accordingly, once the first and second bodies are connected, the interface is the imaginary plane that extends outward from the contact surface between the first body and the second body.

In some embodiments, the axial ends of the first and second bodies may be in direct contact along the interface therebetween. In some embodiments, a gasket may be positioned between the axial ends of the first and second bodies, such that the axial ends of the first and second bodies are adjacent to each other although not necessarily in direct contact with each other. In such a position, the first body may be roughly radially aligned with the second body. Additionally, the first body may be axially close enough to the second body that the two can be successfully connected with the connector.

In embodiments including a gasket between adjacent first and second bodies, the adjacent bodies may maintain a certain level of axial separation even when the full weight of one of the bodies is transmitted through the gasket to the other body but when the connecting assembly is in an unlocked configuration. The amount of axial separation between two adjacent but not fully connected bodies may be referred to as gasket "standoff."

The embodiment shown in FIGS. 1 and 2 is oriented to where a first body is positioned axially on top of a second body, and the main piston is moved vertically downward to a locked position. However, other orientations of the first and second bodies and axial piston movement may be used in application of the present disclosure. For example, a first body may be axially atop a second body in an unlocked configuration with the connector compressed around the first body, and a main piston may move upward to a locked position, causing the connector to be compressed around the second body. In a further example, components to be connected may be oriented in a horizontal position, where axial movement of the main piston around the connector may be horizontal rather than vertical with respect to the ground.

Figure 3:
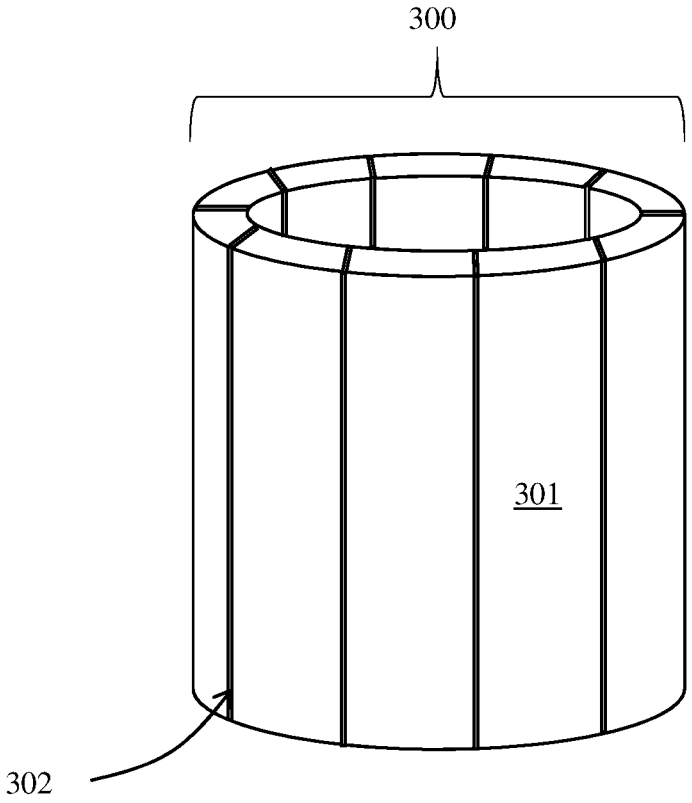
FIG. 3 shows a perspective view of a connector formed of multiple segments according to embodiments of the present disclosure.

As shown in FIG. 3, a connector 300 may include multiple connecting segments 301. The connecting segments 301 may be held in a circumferential arrangement by a main piston, an adjustment ring, or other methods (not depicted here), where a gap 302 may be formed between adjacent segments 301, or in some embodiments, adjacent segments may contact each other at one or more points of contact. Further, the connecting segments 301 may be held together by more than one component along their longitudinal length, for instance, a separate component toward each axial end. In one or more embodiments, the segments 301 are held together to form a generally hollow-cylindrically-shaped connector 300, while the jaws may be formed on the inside of the axial ends of each of the segments 301. Some embodiments of the connector 300 will have 16 segments 301. Other embodiments may have 10 segments (as depicted in FIG. 3) or another number of segments, for instance, 4, 6, 8, 12, 15, 20, 24, or 32. In some embodiments, creating the segments may involve initially forming a connector blank in the shape of a hollow cylinder with the intended internal structure (e.g., teeth) that is subsequently cut into multiple segments having a radial segment shape. The connector blank may be precisely cut in the axial direction or may be cut at an angle deviating from axial direction. A connector formed this way may have essentially identical segments or may have segments of multiple sizes and/or geometries.

Connecting assemblies of the present disclosure may include locking profiles and corresponding receiving profiles having multiple ridges, or teeth, and multiple corresponding grooves. For example, a locking profile may include 1, 2, 3, 4, 5, 6, or more teeth, and a corresponding receiving profile may include the same amount of grooves as there are teeth in the locking profile (e.g., 1, 2, 3, 4, 5, 6, or more grooves). In some embodiments, the number of teeth in the locking profile may be less than the number of grooves in the corresponding receiving profile.

The profile shape of one or more teeth in a locking profile may be a matching inverse of the corresponding groove in which the tooth is to fit. As used herein, a matching inverse means the cross sectional shape of the tooth has substantially the same shape and substantially the same size as the cross sectional shape of the corresponding groove, where the size of the cross sectional shape of the tooth allows the tooth to fit within the corresponding groove with minimal tolerance gaps.

Figure 4:
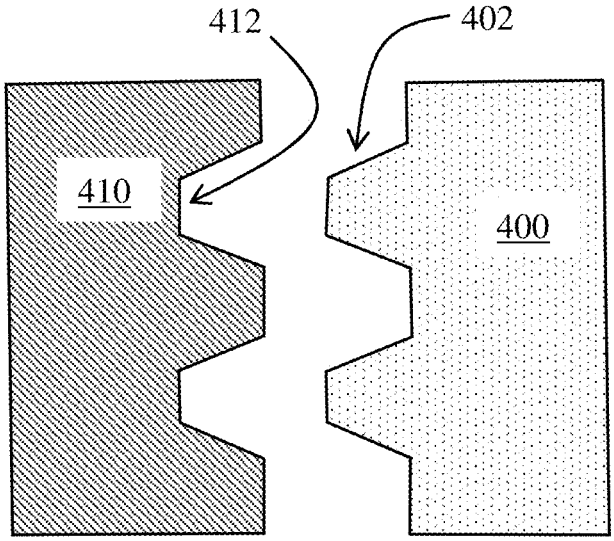
FIG. 4 shows a locking profile and corresponding receiving profile according to embodiments of the present disclosure.
Figure 5:
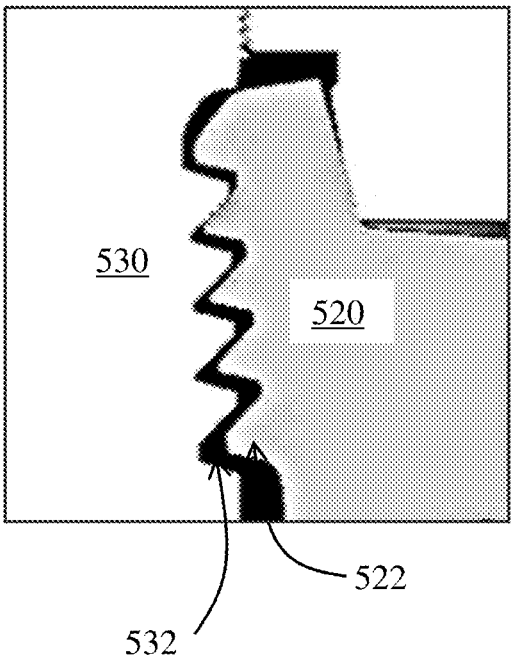
FIG. 5 shows a cross sectional view of a body being connected to a connector jaw according to embodiments of the present disclosure.

FIGS. 4 and 5 show examples of components with locking profiles that are matching inverses with corresponding receiving profiles in components being connected. As shown in FIG. 4, a locking profile formed in a connector 400 includes multiple teeth 402. The locking profile is aligned with a corresponding receiving profile formed in a component 410 to be connected, where the receiving profile includes multiple grooves 412 that have the same shape and substantially the same size as the cross sectional shape of the teeth 402 (where the size of the teeth 402 may fit within the size of the grooves 412, allowing for manufacturing tolerances). In the embodiment shown, the teeth 402 and grooves 412 have trapezoidal cross sectional shapes. Trapezoidal cross sectional shapes of teeth and/or grooves may have angled corners, such as shown in FIG. 4, or may have rounded corners.

In the embodiment shown in FIG. 5, a locking profile formed in a connector 520 includes multiple teeth 522 having a generally triangular cross sectional shape. The locking profile is aligned with a corresponding receiving profile formed in a component 530 to be attached, where the receiving profile includes multiple grooves 532 that have substantially the same shape and size as the cross sectional shape of the teeth 522. Triangular cross sectional shapes of teeth and/or grooves may have angled or rounded corners.

According to embodiments of the present disclosure, the profile shape of one or more teeth in a locking profile may be a non-matching inverse of the corresponding groove in which the tooth is to fit. In other words, although a tooth in a locking profile may fit within a groove of a corresponding receiving profile, the cross sectional shape of the tooth may be different from the cross sectional shape of the corresponding groove.

Figure 6:
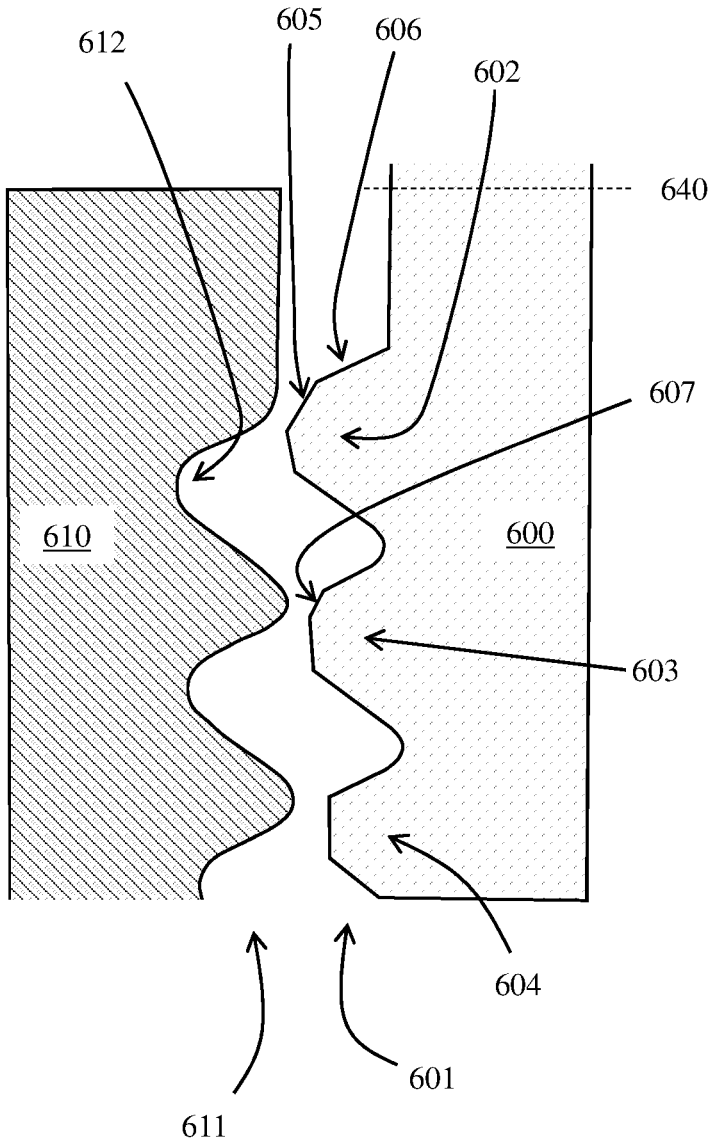
FIG. 6 shows a locking profile and corresponding receiving profile according to embodiments of the present disclosure.

FIG. 6 shows an example of a connector 600 with a jaw locking profile 601 that is a non-matching inverse of a corresponding receiving profile 611 formed in a component 610 to be connected. The locking profile 601 includes multiple teeth 602, 603, 604 having different cross sectional shapes. According to embodiments of the present disclosure, one or more teeth in a locking profile may have a cross sectional shape that is different from the remaining teeth in the locking profile. Thus, although FIG. 6 shows a locking profile with each tooth having a different cross sectional shape, some embodiments may have one tooth with a different cross sectional shape while the remaining teeth each have the same cross sectional shape; some embodiments may have two teeth with a different cross sectional shape(s) while the remaining teeth each have the same cross sectional shape; and other embodiments may have more than two teeth with different cross sectional shapes while the remaining teeth each have the same cross sectional shape.

Further, in the embodiment shown, the receiving profile 611 includes multiple grooves 612 that each have a different cross sectional shape than the cross sectional shape of the teeth 602, 603, 604. The teeth 602, 603, 604 each have a general cross sectional shape of a truncated triangle, while the grooves 612 each have a general cross sectional shape of a triangle with a rounded tip. However, other cross sectional shapes of grooves and teeth may be utilized according to embodiments described herein, including for example, triangular or trapezoidal cross sectional shapes with rounded and/or angled corners. Further, according to embodiments of the present disclosure, one or more grooves in a receiving profile may have a different cross sectional shape than the cross sectional shape of teeth in a corresponding locking profile, while the remaining grooves in the receiving profile may have the same cross sectional shape as the cross sectional shape of the remaining teeth in the corresponding locking profile.

Teeth in a locking profile may be designed for sequential interaction with a corresponding receiving profile as the locking profile is engaged with the receiving profile. For example, as described above, a jaw of a connector may be locked around a body by substantially aligning the locking profile of the jaw with a receiving profile formed in the body and then sliding a main piston around the jaw. As the main piston slides axially around the connector, the main piston may apply radially inward force sequentially to each tooth of the jaw of the connector in the axial order in which the main piston slides, thereby engaging the locking profile of the jaw with the receiving profile of the body. For example, in the embodiment shown in FIGS. 1 and 2, as the main piston 130 slides in an axial direction from the first end 101 of the connector to the second end 102 of the connector, increasing radially inward force may be applied to each tooth of the second jaw 104 sequentially in the direction of axial movement of the main piston 130 through direct contact of the main piston and the second end 102 of the connector. In other embodiments, axial movement of the main piston 130 may indirectly cause the radial inward force of the second end 102 of the connector through direct contact with one or more intermediate components that are disposed between the main piston and the second end.

In such a manner, as a main piston slides axially from the axial center of a connector toward an axial end of the connector, a first tooth in a jaw axially closest to the axial center of the connector may engage with and lock into a corresponding groove of a receiving profile in a body prior to a second tooth in the jaw moving into final locking position with a corresponding groove of the receiving profile. Further, as the first tooth engages with and moves into a final locking position, axial forces between the tooth locking profile and corresponding receiving profile may aid in moving the bodies being connected toward each other. For example, moving and locking teeth of a connector jaw into corresponding grooves of a first body may axially shift the first body toward a second body already locked to the connector, such that the first and second bodies are connected at a fluid tight interface once the connecting assembly is in a final locking position.

Thus, prior to moving a locking profile into a final locking position with a corresponding receiving profile, the locking profile may be axially offset from the receiving profile. During engagement and locking between a tooth and corresponding groove, the initial axial offset may lead to clashing between the tip of the tooth and an edge of the groove. As used herein, a clash may refer to the hitting of a jaw on an opposite receiving profile during conversion from the unlocked position to the locked position. Accordingly, a clash may inhibit proper engagement between a jaw having a locking profile and the corresponding receiving profile, which may prevent proper connection between the bodies to be connected.

Figure 7:
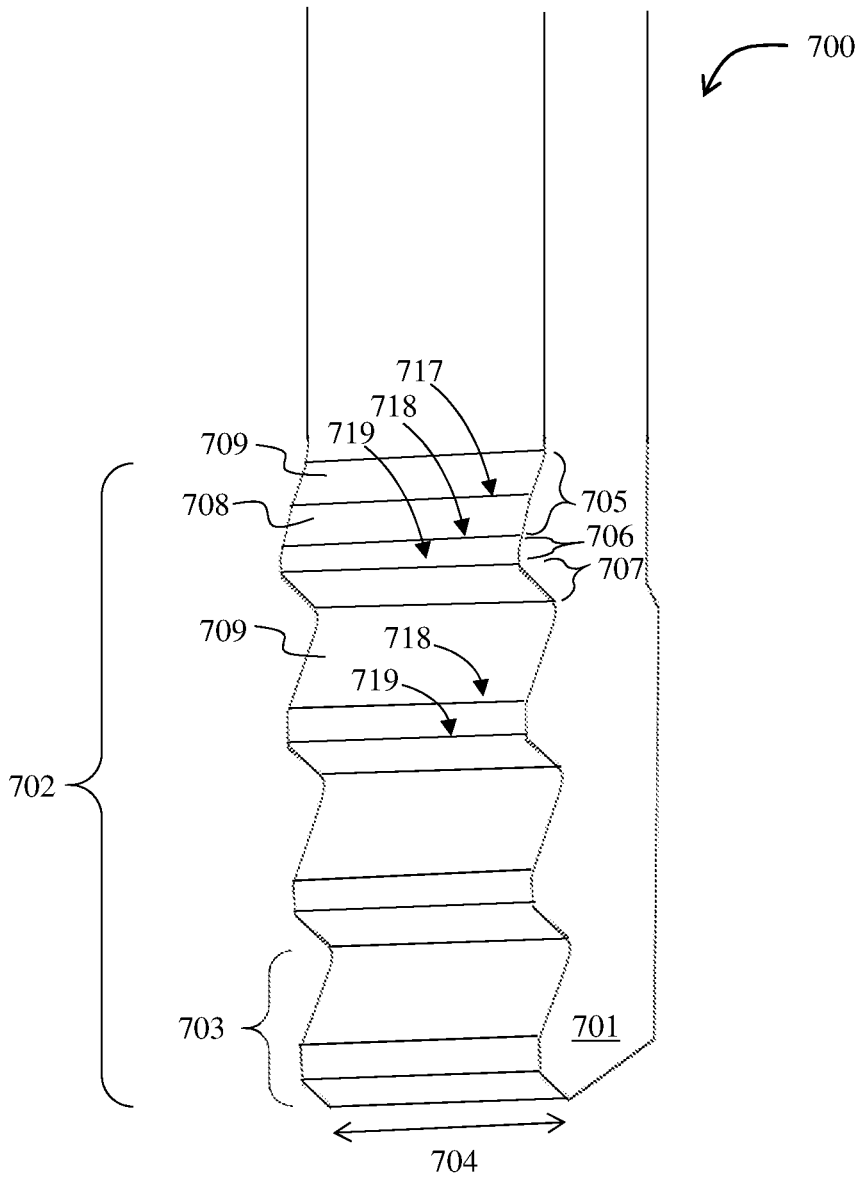
FIG. 7 shows a perspective view of a jaw formed on the inside of a connector according to embodiments of the present disclosure.

According to embodiments of the present disclosure, one or more teeth formed in a connector jaw may have a modified shape to avoid clashing between the jaw and a corresponding receiving profile. The shape of a tooth may be described, in part, in relation to expected interaction with a receiving profile of a body to be connected. For example, FIG. 7 shows a partial perspective view of a single connecting segment 701 of a connector 700. The inside of the segment 701 has a jaw 702 formed by multiple teeth 703 spaced axially apart from each other and extending linearly across the width 704 of the segment 701 (from one side of the segment to the opposite side of the segment). Each tooth 703 forming a jaw 702 of a segment may have a leading side 705, a top side 706, and a trailing side 707 (opposite the leading side of the tooth). A contact point 718 may refer to the angular or curved transition between the leading side 705 and the top side 706 of each tooth. Each tooth has a contact point, whether or not it has an altered surface. An end point 719 may refer to the angular or curved transition between the top side 706 and the trailing side 707 of each tooth. As used herein, a leading side of a tooth may refer to the side of the tooth that first contacts with a corresponding groove in a receiving profile during a connection process. Accordingly, the leading side of a tooth may also, in some embodiments, be the side of the tooth axially closest to the axial center of the connector 700. In some configurations, the leading side of a tooth may also be in contact with the corresponding groove once the connecting assembly is in the locked configuration. A top side of the tooth may refer to the side of the tooth defining the height of the tooth from a base of a tooth, where the tooth begins to protrude from the segment. The trailing side of a tooth may refer to the side of the tooth opposite the leading side, where a thickness of the tooth may be measured between the leading and trailing sides of the tooth. The segment 701 depicted here is not radially curved (i.e., the segment 701, and particularly the contact points 718 and the end points 719, are straight in a direction parallel to the width 704 of the segment); however, in other embodiments, the segment 701 may be curved in the radial direction (i.e., the circumferential direction of the connector 700 as a whole) to better contact and engage with a body that is cylindrical in shape. The segments 701 will often be curved in the circumferential direction when they are formed from a connector blank, having a hollow-cylindrical shape, that has been axially cut into the desired number of segments 701, as described above.

Inclusion of an altered surface (e.g., a bevel or chamfer) may alter the geometry of the leading side of a tooth by breaking up the leading side into at least two distinguishable surfaces, including an altered surface and an engagement surface. An altered surface may refer to a surface along the leading side adjacent to and between the top side of the tooth and an engagement surface of the tooth. An edge point may refer to the transition between the engagement surface and the altered surface. In teeth having an altered surface, the altered surface may serve as the initial point of contact with the corresponding receiving profile before the engagement surface of the tooth contacts the receiving profile during a connecting process. In embodiments having a gasket between the two bodies being connected, the altered surface may energize the gasket to close an initial gasket standoff between the two bodies. In some embodiments, the altered surface may aid in capture by properly capturing the receiving profile at a farther distance than a similar jaw with unmodified teeth. An engagement surface of a tooth may be in contact with the corresponding groove once the connecting assembly is in the locked configuration.

For example, as shown in FIG. 7, a leading side 705 of a tooth 703 may include an altered surface 708 extending from the top side 706 of the tooth to an engagement surface 709, intersecting at an edge point 717 (with an angular or curved transition). The engagement surface 709 may extend between the altered surface 708 and the base of the tooth (at angled and/or curved transitions). The altered surface 708 and the engagement surface 709 may be distinguished from each other, for example, by having substantially constant slopes between adjacent transitions. Thus, teeth having an altered surface on its leading side may intersect at an edge point (either angled or curved) distinguishing two adjacent surfaces. Teeth that do not have an altered surface on its leading side may include a single engagement surface 709 extending the entirety of the leading side, from a base of the tooth to the top side 706 of the tooth, where the single engagement surface may have a substantially constant slope or radius of curvature along its length. Thus, teeth without an altered surface, like the second and third teeth of FIG. 7, may lack an edge point 717.

According to embodiments of the present disclosure, a first tooth in a locking profile of a connector closest to the axial center of the connector may have a leading side modified by the inclusion of an altered surface. Since it has an altered surface, some embodiments of the first tooth will have an edge point at the transition between the engagement surface and the altered surface as well as a contact point at the transition between the altered surface and the top side. The axial distance measured between the edge point and the axial center of the segment is termed the edge distance. Similarly, the axial distance between the contact point and the axial center of the segment is termed the contact distance. Furthermore, the contact distance minus the edge distance is termed the axial contact separation. Since the edge point may be closer to the axial center than the contact point in some embodiments, the edge distance may be less than the contact distance, resulting in a positive value for the axial contact separation. By convention, an axial contact separation for a tooth lacking an altered surface is equal to zero.

In some embodiments, teeth having an altered surface may have a relatively smaller profile than teeth without an altered surface (where an engagement surface extends the entirety of the leading side of the tooth, from the tooth base to the top side of the tooth). In other embodiments, a tooth without an altered surface in a locking profile may have a relatively smaller profile than a tooth in the locking profile having an altered surface. As used herein, a relatively smaller profile may refer to a profile that defines a smaller cross-sectional area than the cross-sectional area defined by the profile being compared. For example, a cross-sectional area comparison may be made between a modified design of a tooth with a relatively smaller profile than what the tooth profile would have been without the modification (e.g., inclusion of an angled surface on the tooth's leading side, as described herein). A cross-sectional area comparison may also be made between a modified tooth and remaining teeth in the same jaw, where the profile of the modified tooth defines a relatively smaller cross-sectional area than the cross-sectional area defined by the profile of a remaining tooth in the jaw.

As shown in the embodiment of FIG. 7, a tooth 703 may extend linearly across an entire width 704 of the segment on which the tooth is formed. In some embodiments, the profile of a tooth, defined by the cross-sectional shape of the tooth along an axial plane perpendicular to the surfaces at the leading, top and trailing sides of the tooth, may be uniform along the entire width of the tooth. A tooth having a modified design such as an altered surface formed at its leading side (e.g., a first tooth of a jaw that is axially closer to an axial center of the connector than the remaining teeth of the jaw) may have a positive axial contact separation.

In some embodiments, a tooth with a modified design (e.g., a tooth having an altered surface) may have a contact distance that is at least 1% greater than (e.g., greater than 2%, greater than 5%, greater than 10%, or greater than 20%) its edge distance. The difference between the contact distance and edge distance, i.e., the axial contact separation, of a tooth altered surface may be designed to account for a gasket standoff from the bodies being connected with the connector. For example, a modified tooth may be designed to have an altered surface with an axial contact separation that is greater than the interference between a contact point on a connecting segment and a contact point on a receiving profile that includes a gasket standoff.

A tooth having a modified design such as altered surface formed at its leading side (e.g., a first tooth of a jaw that is axially closer to an axial center of the connector than the remaining teeth of the jaw) may have a greater axial contact separation than the axial contact separation of a different tooth of the same jaw (e.g., an end tooth that is axially farther from an axial center of the connector than the remaining teeth of the jaw).

In some embodiments, a tooth with a modified design (e.g., a tooth having an altered surface) and with a positive axial contact separation may also have a shorter engagement surface (measured along the engagement surface from the base of the tooth to the altered surface) than a different tooth formed on the same jaw. For example, a tooth having a modified design such as an altered surface formed at its leading side (e.g., a first tooth of a jaw that is axially closer to an axial center of the connector than the remaining teeth of the jaw) may have an engagement surface that is shorter than the engagement surface of a different tooth on the same jaw (e.g., an end tooth that is axially farther from an axial center of the connector than the remaining teeth of the jaw).

In some embodiments, the first and second teeth in a locking profile closest to the axial center of the connector may both have leading sides modified to have positive axial contact separations. In some embodiments, the axial contact separation for the first tooth may be greater than the axial contact separation for the second teeth. In some embodiments, the axial contact separation for the first and second teeth may be equal. In some embodiments, one or more of these altered surfaces may provide the initial contact surface for the entire jaw. In some embodiments, initial contact to the corresponding receiving profile may occur in the middle of one or more of the altered surfaces. Alternatively, one or more of the contact points or the edge points, or a mixture of points and surfaces, may provide the initial contact surface for the entire jaw.

Figure 8:
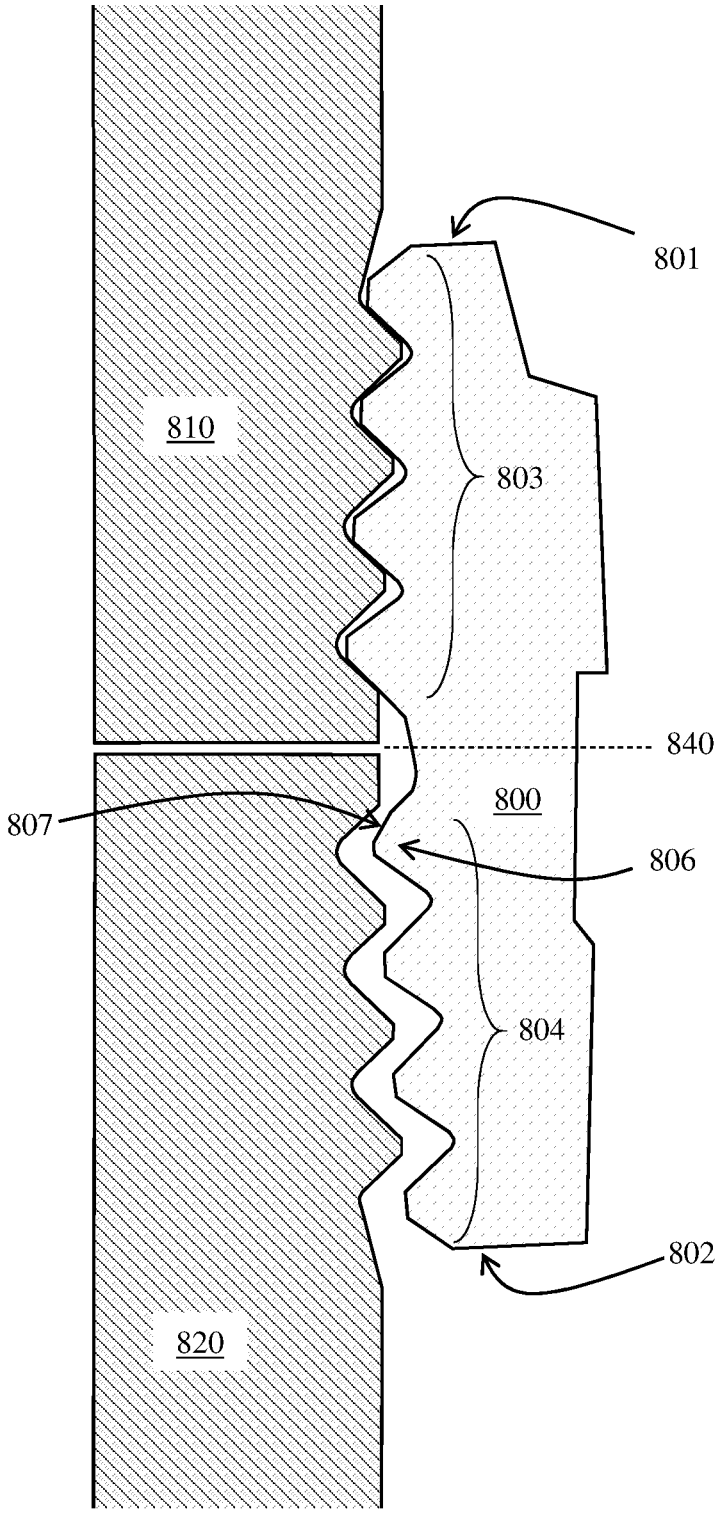
FIG. 8 shows a cross sectional view of two bodies being connected together by a connector according to embodiments of the present disclosure.

For example, FIG. 8 shows a cross sectional view of a connector 800, used to connect a first body 810 to a second body 820, where the connector 800 has a first tooth modified with a relatively smaller profile than the remaining teeth of the locking profile. As shown, the connector 800 has a first end 801, a first jaw 803 formed on the inside of the connector near the first end, a second end 802 at the opposite axial end from the first end 801, and a second jaw 804 formed on the inside of the connector near the second end 802. The cross sectional view of the first and second jaws 803, 804 show the locking profiles formed by the teeth of each jaw. Further, the cross sectional view of the first and second bodies 810, 820 show receiving profiles of grooves formed around the axial ends of the bodies. When axially aligned, the locking profiles of the connector may fit within corresponding receiving profiles in the first and second bodies 810, 820. In the embodiment shown, a first tooth 806 that is axially closest to the axial center 840 of the connector has an altered surface 807 defining a tooth profile that is relatively smaller than the remaining teeth in the second jaw 804.

In some embodiments, an altered surface formed along the leading side of a tooth may be expected to first contact with a corresponding receiving profile during the connection processes described herein. For example, in the embodiment shown in FIG. 8, the side of the tooth 806 closest to the axial center 840 of the connector (referred to herein as a leading side) includes an altered surface 807 that is expected to contact the corresponding receiving profile in the second body 820 before any other surface of the tooth 806 contacts the corresponding receiving profile. In some embodiments, an altered surface of a tooth closest to the axial center of a connector may contact the corresponding receiving profile before any other surface of the entire jaw, including before engagement surfaces of the remaining teeth in the jaw. In some embodiments, altered surfaces formed in the first two teeth in a jaw closest to the axial center of a connector may contact edges of a corresponding receiving profile at substantially the same time during a connecting process and before any other surface of the entire jaw contacts the corresponding receiving profile.

Modification in design of an axially central tooth (e.g., the first tooth in a locking profile closest to the axial center of the connector) or modification in design of axially central teeth (e.g., the first and second teeth in a locking profile closest to the axial center of the connector) may include changing the spacing and/or angle and/or slope and/or shape of the axially central tooth/teeth in comparison to the remaining teeth in the locking profile to ensure clash-free engagement occurs between said locking profile and the corresponding receiving profile. Such modification of an axially central tooth/teeth may lower the axial height of the first point of contact between the first tooth and the corresponding groove in the body to be connected, allowing connectors with these modified designed teeth to successfully engage at relatively higher pre-loads. Once engaged, the modified designed teeth may start to pull the two bodies being connected together, which may energize a gasket and lower the final standoff between the two bodies, if a gasket is present. At this point, the remaining teeth in the locking profile may engage successfully, and the full pre-load generation of the bodies commences.

Modification in design of an axially central tooth may include an altered surface disposed at the side of the tooth expected to contact a corresponding groove during a connection process. The altered surface may provide a relatively larger axial contact separation when compared with the remaining teeth in the locking profile. For example, referring again to the example shown in FIG. 6, a connector 600 has a first tooth 602 axially closest to the axial center 640 of the connector with an altered surface 605 formed along the leading side 606 of the tooth 602. A second tooth 603 in an axially second closest position to the axial center 640 of the connector may also have an altered surface 607 formed along the leading side of the second tooth 603. In the embodiment shown, the first tooth 602 has a larger altered surface 605 (and thus larger axial contact separation) than the altered surface 607 in the second tooth 603, and the second tooth 603 has a greater axial contact separation than the remaining teeth (604) in the locking profile 601.

In some embodiments, a first and second tooth axially closest to an axial center of a connector may have the same sized altered surface. In some embodiments, the first tooth axially closest to an axial center may have a larger altered surface than the second tooth, while each remaining teeth in the locking profile may lack an altered surface. In some embodiments, a first tooth axially closest to the axial center of a connector may have an altered surface, and each of the remaining teeth in the locking profile may not have an altered surface as described herein. In some embodiments, the first three teeth axially closest to an axial center of a connector may have altered surfaces formed that alter their leading sides (either same-sized altered surfaces or different-sized altered surfaces), and each of the remaining teeth in the locking profile may not have an altered surface. In some embodiments, a number greater than three (e.g., 4, 5, or more) teeth axially closest to an axial center of a connector may all have altered surfaces formed that alter their leading sides (either same-sized altered surfaces or different-sized altered surfaces), and each of the remaining teeth in the locking profile may not have an altered surface. In some embodiments, all teeth of a connector may have altered surfaces formed that alter their leading sides (either same-sized altered surfaces or different-sized altered surfaces).

One or more teeth in a jaw having a modified axially central tooth/teeth may be without an altered surface, where an engagement surface extends the entire leading side of the tooth, from its base to the top side of the tooth, having a substantially constant slope or radius of curvature between the transition to the base and the transition to the top side of the tooth. Providing a relatively larger leading side on teeth closer to an axial end of a connector when compared with a modified axially central tooth/teeth may allow for better locking engagement between the corresponding tooth and groove without increased likelihood of clashing, as teeth at the axial end of a connector are less prone to clashing issues.

Described in another way, an altered surface or other modification in tooth design to make the tooth profile having a relatively larger axial contact separation than the other teeth in a locking profile may provide an altered surface between the engagement surface of the tooth and the top side of the tooth. For example, FIGS. 9A and 9B show a locking profile 900 of a jaw on a connector according to embodiments of the present disclosure having a first tooth with a relatively larger axial contact separation than the remaining teeth in the jaw.

Figure 9A:
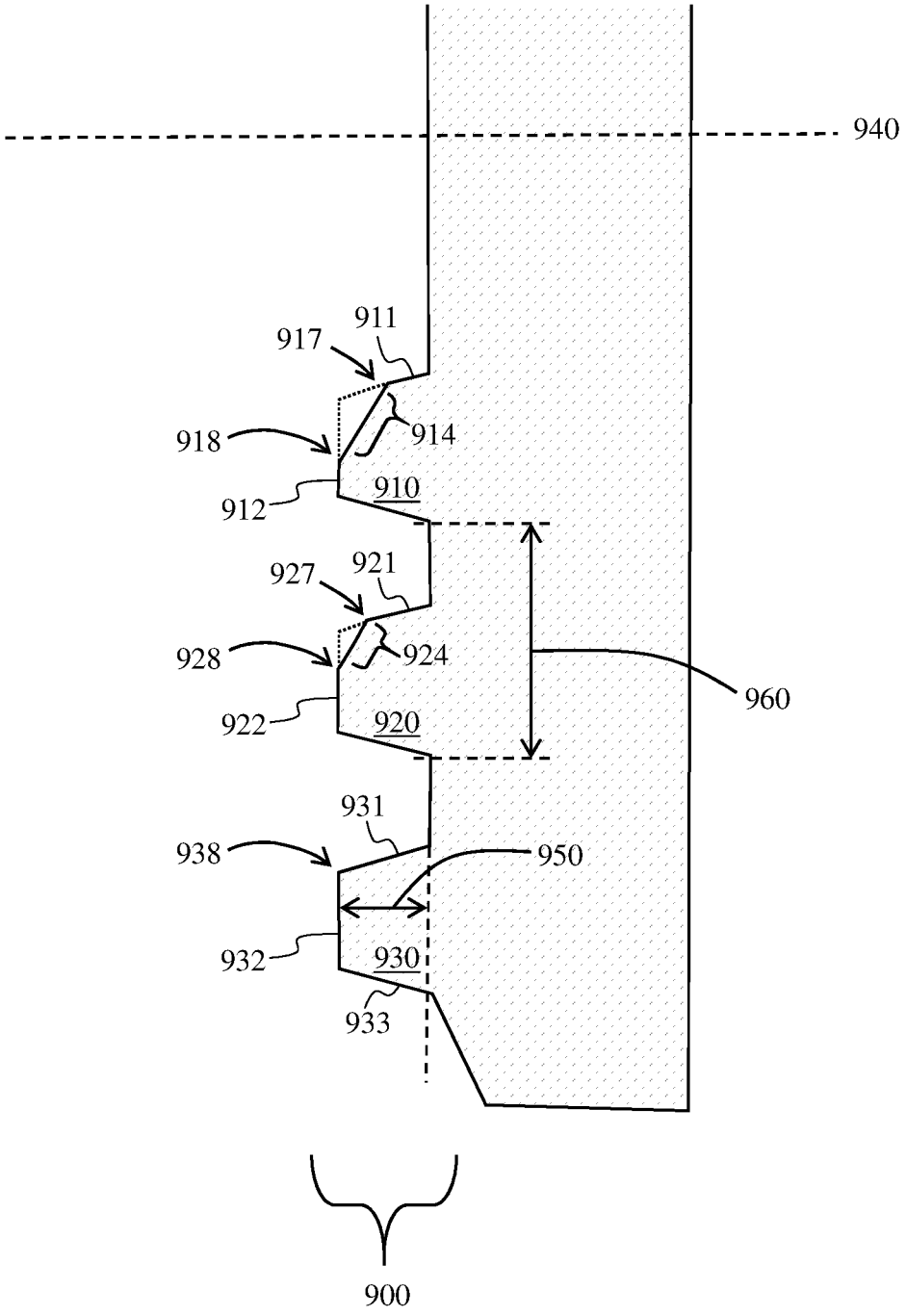
FIGS. 9A and 9B show a locking profile of a connector according to embodiments of the present disclosure.

In FIG. 9A, locking profile 900 shows the cross sectional shape of multiple teeth 910, 920, 930 forming the jaw, where each tooth has a leading side, a top side and a trailing side. A tooth height 950 may be measured from the base of the tooth (e.g., at the lowest point of the grooves formed between adjacent teeth) to an apex of the top side of the tooth. A tooth thickness 960 may be measured between the leading side and trailing side of the tooth. In the embodiment shown, the teeth have increasing thicknesses from proximate the top side of the teeth to the base of the teeth (e.g., between the lowest points of the adjacent grooves at opposite sides of the tooth). One or more teeth forming a jaw in connectors of the present disclosure, shown by tooth 930, has a leading side 931 with a substantially uniform slope that intersects with a top side 932 of the tooth at an angled or curved transition at the contact point 938. The top side 932 of the tooth 930 may have a substantially uniform slope, such as shown in FIG. 9A, or may be curved, and may intersect with the trailing side 933 of the tooth 930 at an angled or curved transition.

The design of a first tooth 910 of the locking profile, closest to an axial center 940 of the connector, is modified to include an altered surface 914 extending between an engagement surface 911 and top side 912 of the tooth 910. The altered surface begins at an edge point 917 located between the engagement surface and the altered surface and ends at a contact point 918 located at the transition between the altered surface 914 and the top side 912. The altered surface 914 may have a slope extending at an angle from a line perpendicular to the apex of the tooth 910 that is greater than the slope of the engagement surface 911 when measured from the line 915 perpendicular to the apex of the tooth 910, bisecting the edge point 917. See FIG. 12, discussed below, for a depiction of one or more embodiments where the slopes of the engagement surfaces and/or altered surfaces are considered. In the embodiment shown, the apex of the tooth 910 is along a substantially flat top side of the tooth. In other embodiments, the apex of a tooth may be at the tip of a curved top side of the tooth.

Figure 9B:
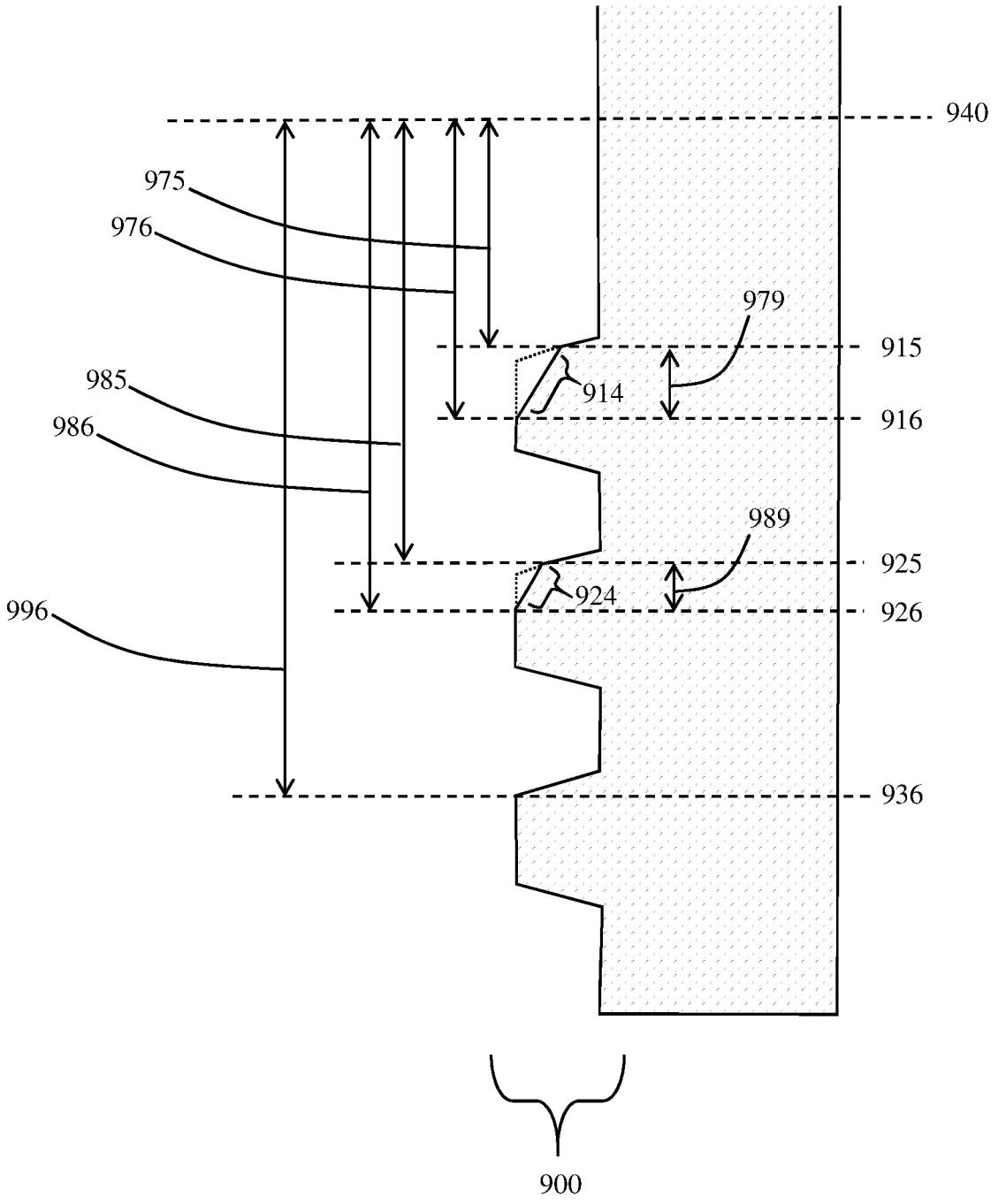

FIG. 9B depicts the distances between the axial center and various points on each tooth. For the first tooth, an edge distance 975 is an axial distance measured between the axial center 940 and a horizontal line 915 that bisects the edge point 917 of the first tooth. Similarly, a contact distance 976 is an axial distance measured between the axial center 940 of the connecting segment and a horizontal line 916 that bisects the contact point of the first tooth 918. A difference between the edge distance and the contact distance is an axial contact separation 979 (i.e., the contact distance minus the edge distance). Some embodiments will have a positive axial contact separation for one or more teeth.

Similarly, a second tooth 920 of a locking profile may be modified to include an altered surface 924 extending between the engagement surface 921 and top side 922 of the tooth 920. An edge point 927 of the second tooth is located between the engagement surface 921 and the altered surface 924. Similarly, a contact point 928 of the second tooth is between the altered surface 924 and the top side 922. The transitions between the altered surface 924 and the engagement surface 921 at the edge point and transition between the altered surface 924 and the top side 922 at the contact point may be angled and/or curved. For the second tooth, an edge distance 985 is measured between the axial center 940 and a horizontal bisector 925 of the edge point 927. Similarly, a contact distance 986 is measured between the axial center 940 and a horizontal bisector 926 of the contact point 928 for the second point. An axial contact separation 989 for the second tooth is calculated as above.

In some embodiments, the axial contact separation 979 of the first tooth may be greater than the axial contact separation 989 of the second tooth. In some embodiments, the axial contact separation 979 of the first tooth may be at least 5% greater than (e.g., greater than 10%, greater than 20%, greater than 50%, greater than 100%, or greater than 200%) the axial contact separation 989 of the second tooth. In some embodiments, the axial contact separations 979, 989 of the first and second teeth may be equal.

In some embodiments, the axial contact separation of the first tooth may be greater than the axial contact separation of another tooth. In some embodiments, the axial contact separation of the first tooth may be greater than the axial contact separation of another tooth having a positive axial contact separation. In some embodiments, the axial contact separation of the first tooth may be at least 5% greater than the axial contact separation of another tooth. In some embodiments, the axial contact separation of the first tooth may be between 5% and 30% greater than the axial contact separation of another tooth. In some embodiments, the axial contact separations of the first tooth and another tooth having a non-zero axial contact separation may be equal.

In the embodiment shown in FIG. 9A, the altered surfaces 914, 924 each provide shortened engagement surfaces 911, 921 of the respective teeth 910, 920 (where the length of the engagement surface 911 (measured along the engagement surface from the base of the tooth to the transition to the adjacent surface) of the first tooth 910 is shorter than the length of the engagement surface 921 of the second tooth 920), while the engagement surface 931 of the third tooth 930 has not been altered through the inclusion of any type of altered surface. A tooth that has not been altered by the inclusion of an altered surface, such as the third tooth 930, may have a contact point 938 between the engagement surface and the top side, but not have an edge point. Thus, a contact distance 996 may be measured between the axial center 940 and a horizontal bisector 936 of the contact point 938 for the third tooth. An unaltered tooth that lacks an altered surface and thus lacks an edge point, such as the third tooth 930, may also lack an edge distance. By convention, an axial contact separation for a tooth lacking an altered surface is equal to zero. In some embodiments, the profile distance of an engagement surface on a first tooth axially closest to the axial center of a connector may be greater than the profile distance of an engagement surface on a second closest tooth to the axial center. According to embodiments of the present disclosure, engagement surfaces of multiple teeth in a locking profile may have the same or different profile distances measured between adjacent surface transitions.

Further, the altered surface 924 of the second tooth 920 has a length measured between the transition from the engagement surface 921 to the altered surface 924 and the transition from the altered surface 924 to the top side 922 that is less than the length of the altered surface 914 in the first tooth 910. In some embodiments, the length of an altered surface on a first tooth axially closest to the axial center of a connector may be greater than the length of an altered surface on a second closest tooth to the axial center. According to embodiments of the present disclosure, altered surfaces of multiple teeth in a locking profile may have the same or different lengths measured between adjacent surface transitions.

Although two teeth 910, 920 in a locking profile are shown in FIG. 9A as having modified surface designs to provide relatively larger axial contact separations, some embodiments may include one tooth with a modified surface design, and some embodiments may include more than two teeth with modified surface designs. Modified surface designs disclosed herein may refer to different profile shapes of teeth in a locking profile when compared with the remaining teeth in the same locking profile.

Receiving profiles formed in bodies to be joined may have a variety of configurations, and may be the same or different from each other. For example, a receiving profile may include one or more spaced apart linear grooves, where the geometries of the grooves may be the same or different. In some embodiments, a receiving profile may include grooves that are equally spaced apart along its axial direction, and in some embodiments, a receiving profile may include multiple grooves having different axial separation distances. In some embodiments, a receiving profile may be axisymmetric around the body. A receiving profile may have any number of grooves (e.g. 1, 2, 3, 4, 5, 6, or more).

In some embodiments, both of two bodies to be connected have channels extending through the center of the bodies in an axial direction. Examples of bodies used in oil and gas that have channels are a pipe, wellhead, and tubing head. For instance, the connecting assembly described here may be used to connect two pipes together or to connect a pipe to a wellhead. Connecting two such bodies may provide a fluid connection between the channels of the bodies, which allows fluid to flow freely between them. In some embodiments, the fluid may flow within the two channels in either axial direction.

Furthermore, the channel of one or both bodies may not be a through channel, and instead the channel(s) may branch or end. A Christmas Tree is one example of this type of component that is used in oil and gas. Accordingly, in some embodiments, a connector may be used to connect a pipe or wellhead to a Christmas Tree.

In some embodiments, a connecting assembly described herein may be used to connect a body with a channel to one that lacks a channel. In such a case, the channel-less body may be an end cap or may serve some other purpose. For instance, a lower riser package or a blow-out preventer may be connected to a pipe or wellhead using a connecting assembly according to embodiments described herein. Furthermore, a connector may be used to attach a fluid channel to some other apparatus, such as a storage vessel or testing/processing equipment.

In some embodiments, a connecting assembly described herein may be used to connect two bodies that are both without a channel extending therethrough. A channel in either body is not necessary for deployment of a connection system according to embodiments described herein.

Further, bodies to be connected by a connecting assembly disclosed herein may have various shapes, including, for example, an overall generally cylindrical shape (e.g., a straight pipe), or a bent cylindrical shape (e.g., a pipe with one or more turns). In some embodiments, a body being connected may have an irregular shape with one or more cylindrically shaped ports, such as a manifold, or other type of block component having one or more cylindrically shaped outlets/inlets, where cylindrically shaped ports may be connected through a connecting assembly disclosed herein.

A process for performing the connection of a first and second body, according to one or more embodiments, may include connecting a connecting assembly described herein to a first body. The connecting assembly used may include a connector, a main piston, and any other component used to hold the connecting segments of the connector in a circumferential arrangement around the second body according to the one or more embodiments described herein. The connecting assembly may be attached to the first body on its first axial end. In one or more embodiments, connecting the first body and connecting assembly may be performed off-site, for instance in a factory or in a centralized facility. Alternatively, this process may be performed immediately before the connection is made, at a location such as on an off-shore drilling platform or adjacent to the well site.

The connecting assembly may be unlocked by axially translating the main piston into the unlocked position. One embodiment of a connecting assembly in the unlocked configuration can be seen in FIG. 1. As described above, there are many potential axial locations for the main piston when it is in the unlocked position. In an unlocked configuration, the first end of the connector may be in a radially inward position such that the first locking profile is engaged with the first receiving profile of the first body to be connected, and the second end of the connector may be in a radially outward position. As above, in one or more embodiments, unlocking the connecting assembly may be performed off-site, for instance in a factory or in a centralized facility. Alternatively, this process may be performed immediately before the connection is made, at a location such as on an off-shore drilling platform or adjacent to the well site.

To connect a first body to a second body, a first axial end of the first body may be positioned so that it interfaces with a second axial end of a second body. Additionally, a first receiving profile may be radially aligned with a second receiving profile, and a second end of the connector may be radially outside the second axial end of the second body. In some embodiments, a second locking profile formed in the second end of the connector may be radially outside the second receiving profile formed in the second axial end of the second body. Furthermore, in such a configuration, the channels of the first and second bodies may also be aligned and coaxial.

In some embodiments, a second body may be essentially stationary while a first body and pre-connected connecting assembly may be relatively mobile. The second body may be capable of small movements due to the environment (e.g., waves, currents, geological motion, equipment vibration), but not substantial movement to intentionally alter its position in preparation for connection. In such a configuration, the first body and pre-connected connecting assembly may be maneuvered into place so they are positioned axially in line with the stationary second body.

One embodiment of this situation may include connecting a new component (first body) to a component that is already in a well line (second body). In such a system, the second body may either be the well line or a component already connected to the wellhead, in some embodiments. In contrast, the first body, in some embodiments of such a system, may be a new, unattached component. Accordingly, the first body and a pre-connected connecting assembly as described herein may be maneuvered into place axially in-line with the second body, in order to connect the new component to the existing component of a well line.

Converting the system from the unlocked configuration to the locked configuration may include translating a main piston in the connecting assembly axially from an unlocked position to a locked position. This movement ultimately causes an axial end of the connector to move radially inward. In some embodiments, there may be one or more intermediate components that transfer the axial movement of the main piston into inward radial movement of the axial end of the connector.

Capturing a second receiving profile with a second locking profile may occur when an axially central part of the second locking profile successfully passes the outermost edge of second receiving profile. A successful capture may be one which results in both locking profiles of the connector fully interlocked with both receiving profiles of the two bodies being connected. Successful captures may further be ones where a clash between the edges of the teeth and corresponding grooves is successfully avoided. The tooth closest to the axial center of a connector may be the part of the locking profile that initially engages with the corresponding receiving profile, according to some embodiments. This first tooth may have an altered surface.

In the locked configuration, the connecting assembly may prevent the connected first and second bodies from moving apart. In this configuration, the main piston is in the locked position, which keeps both the first and second axial ends of the connector in the radially inward positions. In such a position, the first locking profile is interlocked with the first receiving profile and the second locking profile is interlocked with the second receiving profile. In some embodiments, there may be one or more intermediate components between the main piston and the connector (at either or both axial ends) that directly keep the first and second axial ends of the connector in the radially inward positions.

When a second body is not connected, the main piston may be moved between the locked position and the unlocked position. However, in some embodiments, when the connecting assembly is engaged with both a first body and a second body, it may be possible to secure the main piston such that the main piston cannot readily move from the locked position to the unlocked position. In such a system, it may be unnecessary to continuously apply force on the main piston to keep it from axially moving out of the locked position. Therefore, in some embodiments, it may be unnecessary to constantly maintain force, such as can be exerted by hydraulic pressure, to keep the connecting assembly in the locked configuration. In some embodiments, axially translating the main piston to the locked position may also secure it. Alternatively, in some embodiments, securing the main piston may include additional steps in addition to the axial translation of the main piston into the locked position. In any case, there are clear advantages to a system where, once locked, the main piston in a connecting system does not need continuous external input to stay locked, particularly for remote applications like subsea drilling.

In some embodiments, the axial movements of the main piston may be controlled with hydraulic actuators. Accordingly, in some embodiments of the method, actuation of hydraulic actuators may produce the necessary axial movements of the main piston. In some embodiments, mechanical means may be used to axially move the main piston in a connecting assembly.

Figure 10:
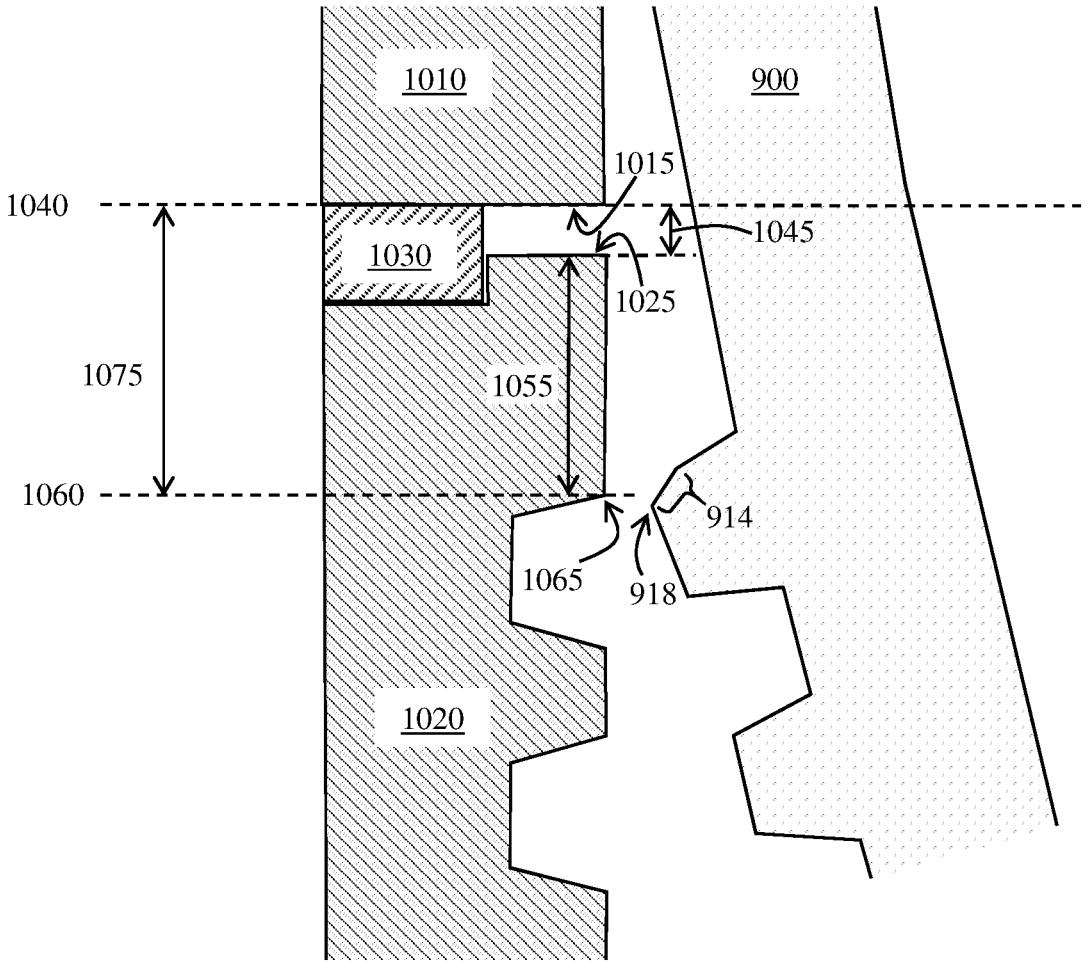
FIG. 10 shows a cross sectional view of a body according to embodiments of the present disclosure.

FIG. 10 depicts a partial cross sectional view of a first body 1010 and a second body 1020 that are axially aligned with a gasket 1030 between the two compared with the connector 900 from FIG. 9 in an unlocked configuration. One having skill in the art will readily realize that this figure, and in particular its depiction of the gasket, is a schematic representation and does not necessarily reflect the actual geometry or relative scale of an actual device according to this disclosure. A gasket standoff 1045 may be measured axially between a first axial end 1015 of the first body and a second axial end 1025 of the second body due to the intervening gasket 1030, when the connecting system is in an unlocked configuration. In some embodiments, when in the locked configuration, the connecting system may cause the gasket to be compressed. Thus, the gasket standoff may be measured when the gasket is uncompressed (e.g., when the connecting system is in an unlocked configuration). An axial center 1040 of the connector 900 is depicted in FIG. 10 as substantially aligning with the top of the gasket 1030 in the unlocked configuration. However, in other embodiments, the axial center of a connector may be located along other axial positions along the first body, second body, or gasket. A second body contact distance 1055 may be measured between a horizontal bisector 1060 of a second body contact point 1065 and the second axial end 1025 of the second body. A groove total contact distance 1075 can also be measured between the axial center 1040 and the horizontal bisector 1060 of the second body contact point 1065. Thus, groove total contact distance 1075 may be equal to the second body contact distance 1055 plus the gasket standoff 1045 when the axial center 1040 of the connector aligns with the first axial end 1015. Similar measurements may be made for subsequent grooves (not depicted).

Consider the act of locking the bodies depicted in FIG. 10 with the connector of FIG. 9. One having skill in the art will realize that the groove total contact distance 1075 of the first groove may not be substantially greater than a contact distance 976 of the first tooth or connection may not occur and/or a clash may happen. Thus, the contact distance 976 may be greater than or equal to the groove total contact distance 1075. In some embodiments, as shown in FIG. 10, the contact distance 976 may be greater than or equal to the second body contact distance 1055 plus the gasket standoff 1045. Although the axial center 1040 of a connector may vary depending on the shape and size of the connector, the groove total contact distance 1075 and contact distance 976 are still measured relative to the same reference point, and thus, proportions may remain constant during design of the modified tooth. A person having skill in the art would recognize that, given the addition of an altered surface 914, comparing these distances may indicate whether a contact point 918 of the tooth will successfully engage with the first groove by overcoming the second body contact point 1065 or whether a clash will occur, according to one or more embodiments. Furthermore, the relevant distances on the connector 900 are not depicted in FIG. 10 because they may be measured on an unstrained body relative to an axial center of said connector.

According to embodiments of the present disclosure, an axial contact separation may be designed according to the following equation:

$$\text{Axial contact separation} \geq B+C-A,$$

where A is the edge distance in the locking profile, B is the contact distance in the corresponding receiving profile, and C is the gasket standoff. For example, referring again to FIG. 9 and FIG. 10, the axial contact separation 979 may be greater than or equal to the contact distance 1055 plus the gasket standoff 1045 minus the edge distance 975.

As described above, one or more teeth of the second locking profile axially closest to the axial center (e.g., the first tooth and second tooth), in some embodiments, may have a shape that is modified to aide in capturing the second receiving profile. Thus, one or more teeth of the second locking profile are modified to include a capturing profile. Some potential embodiments of said capturing profile can be seen in FIGS. 11A-11F. Each tooth has an engagement surface 1111 and a top side 1112 with an altered surface 1114 disposed between the two. Since these teeth all include a capturing profile, each includes an edge point 1117 at a transition from the engagement surface to the altered surface as well as a contact point 1118 at a transition from the altered surface to the top side. An axial contact separation 1179A to 1179F for each depicted tooth may be axially measured between an edge point horizontal bisector 1115 and a contact point bisector 1116. The capturing profile of the closest tooth/teeth may result in a non-zero axial contact separation. The capturing profile may be produced by removing a portion of the leading side proximate to the engagement surface of each modified tooth to form an altered surface. One embodiment of a capturing profile, which is detailed above, is the inclusion of an altered surface. The altered surface can form a known shape including any of: a bevel, a chamfer, a fillet, and other shapes. Furthermore, the altered surface may be straight (e.g., a bevel, chamfer, or angled surface), curved (e.g., fillet, elliptical surface, a curved surface, or a compound radius surface), some combination of these, or some other shape. FIGS. 11A, 11C, 11E, and 11F have altered surfaces 1114 that include one or more straight line segments. Alternatively, FIGS. 11B and 11D have altered surfaces 1114 that include one or more curved line segments. The altered surfaces 1114 depicted in FIGS. 11C and 11F include two line segments of the same type. While the altered surfaces of FIGS. 11C and 11F are formed with two straight line segments, additional embodiments may be formed with two or more curved line segments. Finally, additional embodiments may include more than two line segments and/or may mix curved and straight line segments to form the altered surface. The capturing profile may modify the top side and/or the engagement surface, and may serve as a transition between the top side and the engagement surface.

Figure 11A:
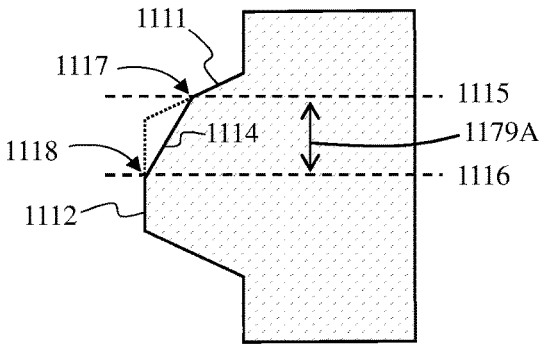
FIG. 11A-11F depict teeth with an altered surface according to various embodiments of the present disclosure.
Figure 11B:
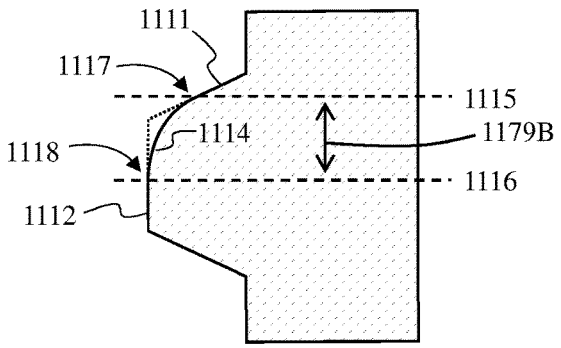
Figure 11C:
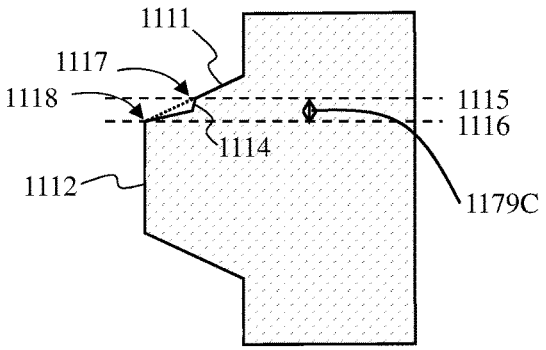
Figure 11D:
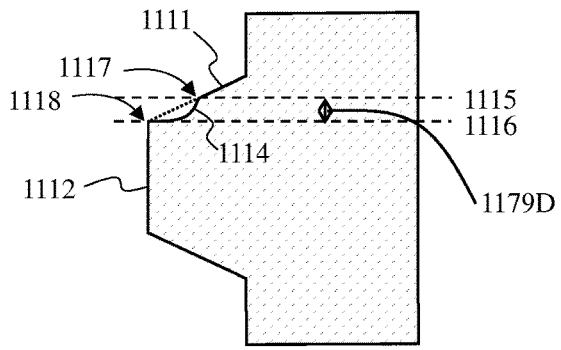
Figure 11E:
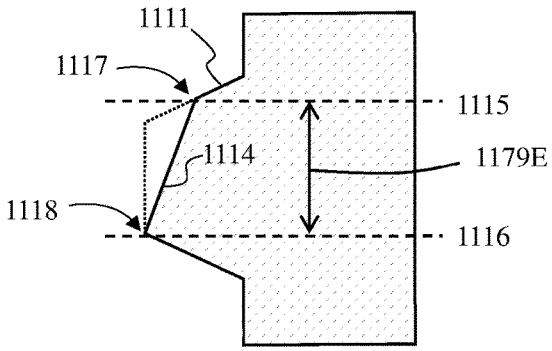
Figure 11F:
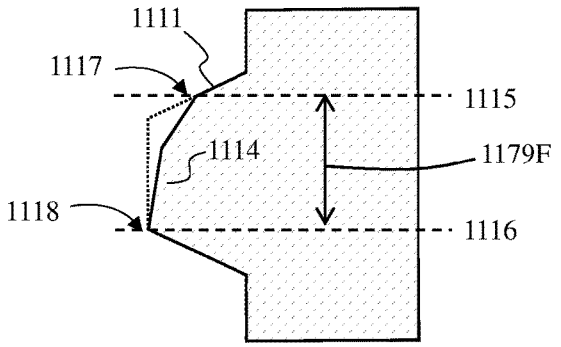

As can be seen in FIGS. 11A-11F, the magnitude of the axial contact separation depends on the locations of the edge and contact points for a given tooth. In FIGS. 11A and 11B, the altered surface starts midway along the unaltered engagement surface and ends midway along the top side. In FIGS. 11C and 11D, the altered surface begins and ends within the unaltered engagement surface, thus the contact point is the same as for an unaltered tooth. Finally, in FIGS. 11E and 11F, the altered surface starts midway along the unaltered engagement surface and ends where the top side meets the trailing side. FIG. 11A depicts a chamfer, FIG. 11B depicts a convex fillet, FIG. 11D depicts a concave fillet, and FIG. 11E depicts a bevel. FIGS. 11C and 11F both depict complex shapes formed from two straight line segments, however FIG. 11C is concave and FIG. 11F is convex. Because the contact points and the edge points are consistent within each pair of teeth (i.e., FIGS. 11A-11B; FIGS. 11C-11D, and FIGS. 11E-11F), they have the same axial contact separation. Thus, the axial contact separations 1179A and 1179B are equal; the axial contact separations 1179C and 1179D are equal; and the axial contact separations 1179E and 1179F are equal. FIGS. 11E and 11F, depicting a fillet and a complex straight shape, have a longer axial contact separation because the altered surface extends to the start of the trailing side, reducing the topside to a single point.

Figure 12:
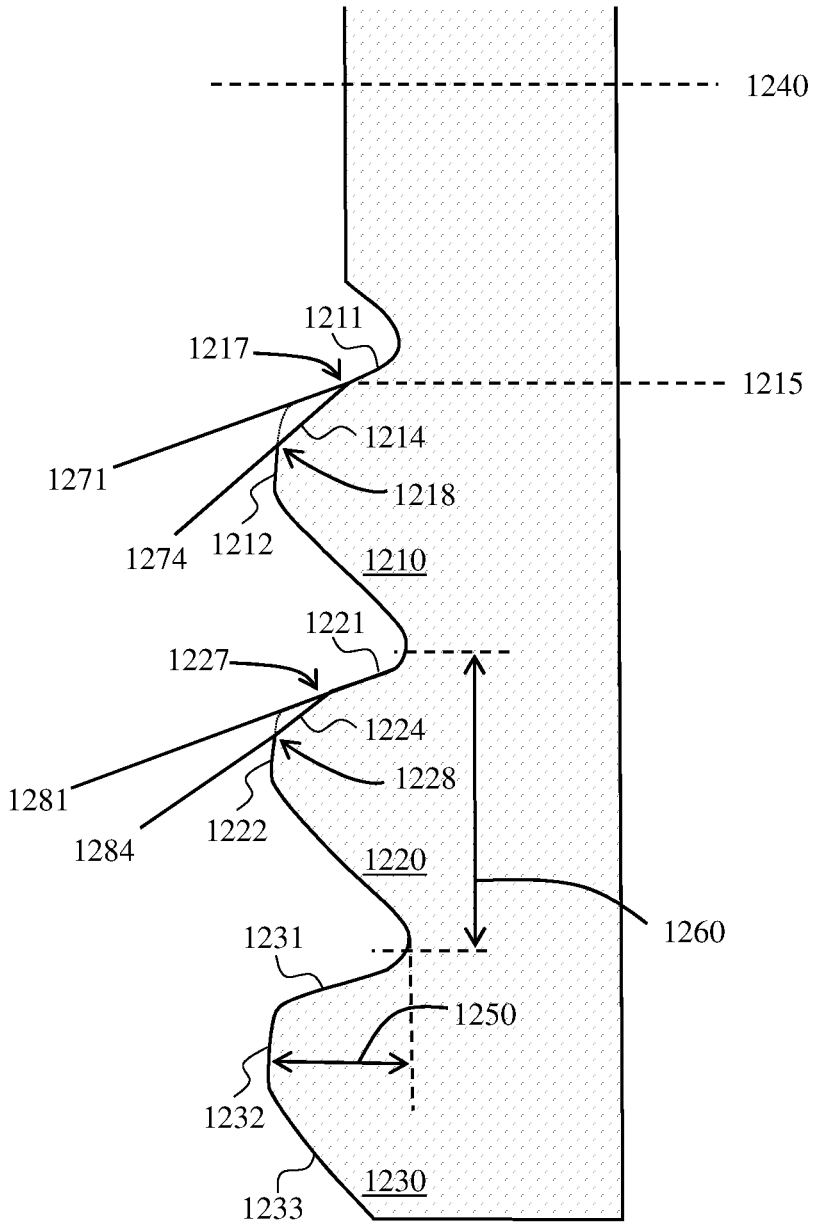
FIG. 12 depicts a cross sectional view of a locking profile where the altered surfaces have a shape of a chamfer.

FIGS. 12-17, discussed below, show various locking profiles according to embodiments of the present disclosure, each of which depict an alternative way to discuss and/or quantify the altered surface. FIG. 12 depicts one or more embodiments where the altered surfaces of the first and second teeth have a shape of a rounded chamfer. The design of a first tooth 1210 of the locking profile, closest to an axial center 1240 of the connector, is modified to include an altered surface 1214 extending between an edge point 1217 and a contact point 1218 of the tooth 1210. As shown, the altered surface 1214 has a slope 1274 extending at an angle from the edge point 1217 greater than the slope 1271 of the engagement surface 1211 when measured from a line 1215 that horizontally bisects the edge point. An altered surface 1214 extending at a relatively larger angle from an imaginary line perpendicular to the apex of the tooth may provide a relatively smaller profile of the leading side of the tooth. In the embodiment shown, the apex of the tooth 1210 is along a substantially flat top side of the tooth. In other embodiments, the apex of a tooth may be at the tip of a curved top side of the tooth.

Similarly, a second tooth 1220 of a locking profile may be modified to include an angled surface 1224 extending between extending between an edge point 1227 and a contact point 1228 of the tooth 1220. The transitions between the altered surface 1224, engagement surface 1221, and top side 1222 may be angled and/or curved. The altered surface 1224 has a greater slope 1284 than the slope 1281 of the engagement surface 1221 when measured from a line that horizontally bisects the edge point (not shown here), thereby providing the tooth with a relatively smaller profile when compared to other teeth 1230 in the locking profile.

Figure 13:
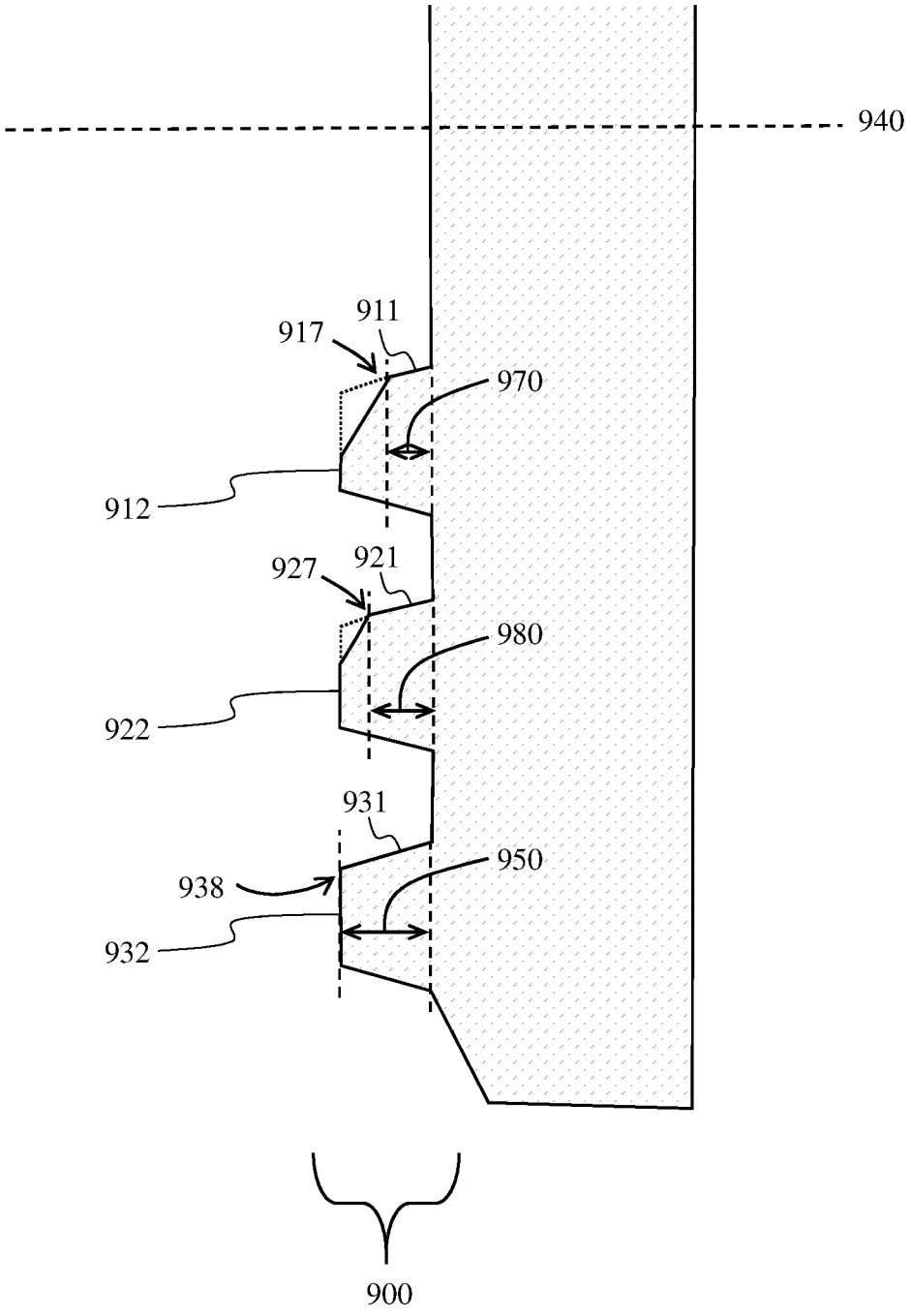
FIG. 13 shows a locking profile of a connector according to embodiments of the present disclosure.

FIGS. 13-17 use the same component numbering as FIGS. 9 and 10. Thus, only the relevant features on each figure are labeled for clarity. FIG. 13 depicts one or more embodiments where the altered surfaces of the first and second teeth have a shape of a chamfer. The design of a first tooth 910 of the locking profile, closest to an axial center 940 of the connector, may be modified to include an altered surface 914 extending between an edge point 917 and a contact point 918 of the tooth 910. A distance between the base of the tooth and a radial bisector of the edge point 917 is the edge height 970. Additionally, the tooth height 950 can be measured between the top side 932 and the base of the tooth. In FIG. 13, the tooth height for all depicted teeth is equal. However, in some embodiments, the tooth height may instead vary between the teeth. The difference between the tooth height 950 and the edge height 970 of a tooth is the altered surface height (not depicted). In some embodiments, a ratio between the edge height 970 and the tooth height 950 of the first tooth may be at least 1/100, 1/75, 1/50, 1/40, 1/30, 1/25, 1/20, 1/19, 1/18, 1/17, 1/16, 1/15, 1/14, 1/13, 1/12, 1/10, 1/9, 1/7, 1/6, 1/5, 1/4, 1/3, 1/2.5, 1/2, 1/1.5, 1/1.25, or 1/1.1.

Similarly, a second tooth 920 of a locking profile may be modified to include an angled surface 924 extending between an edge point 927 and a contact point 928 of the tooth 920. Similarly, an edge height 980 of the second tooth is measured between the base of the second tooth and a radial bisector of the edge point 927. The edge height 980 of the second tooth may be larger than the edge height 970 of the first tooth thereby providing the tooth with a relatively smaller profile when compared to other teeth 930 in the locking profile. In parallel, the altered surface height of the first tooth may be greater than the altered surface height of the second tooth. In some embodiments, the altered surface height of the second tooth 980 may be at least 1%, 2%, 3%, 4%, 5%, 6%, 7%, 8%, 9%, 10%, 12%, 15%, 17%, 20%, 25%, 30%, 40%, 50%, 60%, 70%, 75%, 80%, 90%, 100%, 125%, 150%, 175%, 200%, 250%, 300%, 400%, 500%, or more greater than the altered surface height of the first tooth 970. Alternatively, the edge height of the two teeth 970, 980 may be equal.

The third tooth 930 may lack an edge point. Thus, a tooth height 950 of the third tooth may instead be measured between a base of the tooth and the contact point 938. Thus, the edge heights of the altered teeth, such as the first and second teeth 970, 980, may be less than the tooth height of an unaltered tooth. Additionally, since the third tooth lacks an altered surface, the altered surface height of the third tooth would be zero. Thus, in parallel, the altered surface heights of the first and second teeth may be greater than the altered surface height of the third or later teeth. Finally, one having skill in the art will also readily see that there are reasons for the edge height and/or the tooth height to be altered other than the addition of an altered surface.

Figure 14:
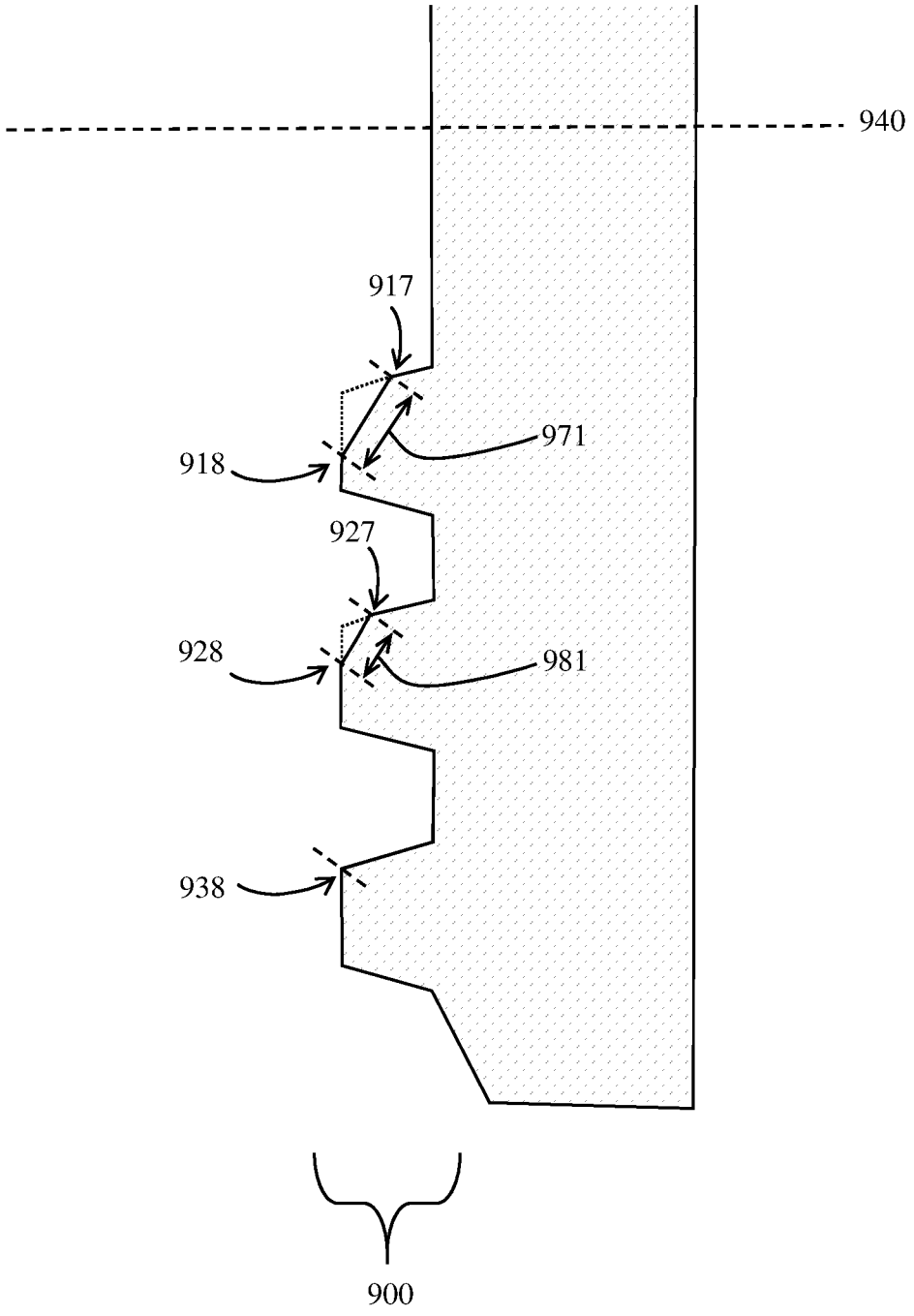
FIG. 14 shows a locking profile of a connector according to embodiments of the present disclosure.

FIG. 14 depicts one or more embodiments where the altered surfaces of the first and second teeth have a shape of a chamfer. The design of a first tooth 910 of the locking profile, closest to an axial center 940 of the connector, may be modified to include an altered surface 914 extending between an edge point 917 and a contact point 918 of the tooth 910. A distance measured between the edge point 917 and the contact point 918 is an altered surface length 971. The altered surface length may be measured either as the shortest distance between the points or as the distance along the altered surface between the points. In the embodiment drawn in FIG. 14, the altered surface length measured using either method would be substantially equivalent. However, those two methods of measuring the distance may not be equivalent in many other embodiments, including any embodiment where the altered surface includes curved lines, curved transitions, and/or more than one line.

Similarly, a second tooth 920 of a locking profile may be modified to include an angled surface 924 extending between an edge point 927 and a contact point 928 of the tooth 920. A distance measured between the edge point 927 and the contact point 928 is an altered surface length 981. The altered surface length 981 of the second tooth may be smaller than the altered surface length 971 of the first tooth thereby providing the tooth with a relatively smaller profile when compared to other teeth 930 in the locking profile. Thus, the altered surface length of the first tooth 971 may be at least 1%, 2%, 5%, 7% 10%, 15%, 20%, 25%, 50%, 75%, 100%, 200%, or more greater than the altered surface length of the second tooth 981. Alternatively, the altered surface length of the two teeth 971, 981 may be equal.

The third tooth 930 may lack an edge point and an altered surface. Thus, an altered surface length of the third tooth may be equal to zero. Therefore, the altered surface lengths of the altered teeth, such as the first and second teeth 971, 981, may be greater than the altered surface length of an unaltered tooth.

Figure 15:
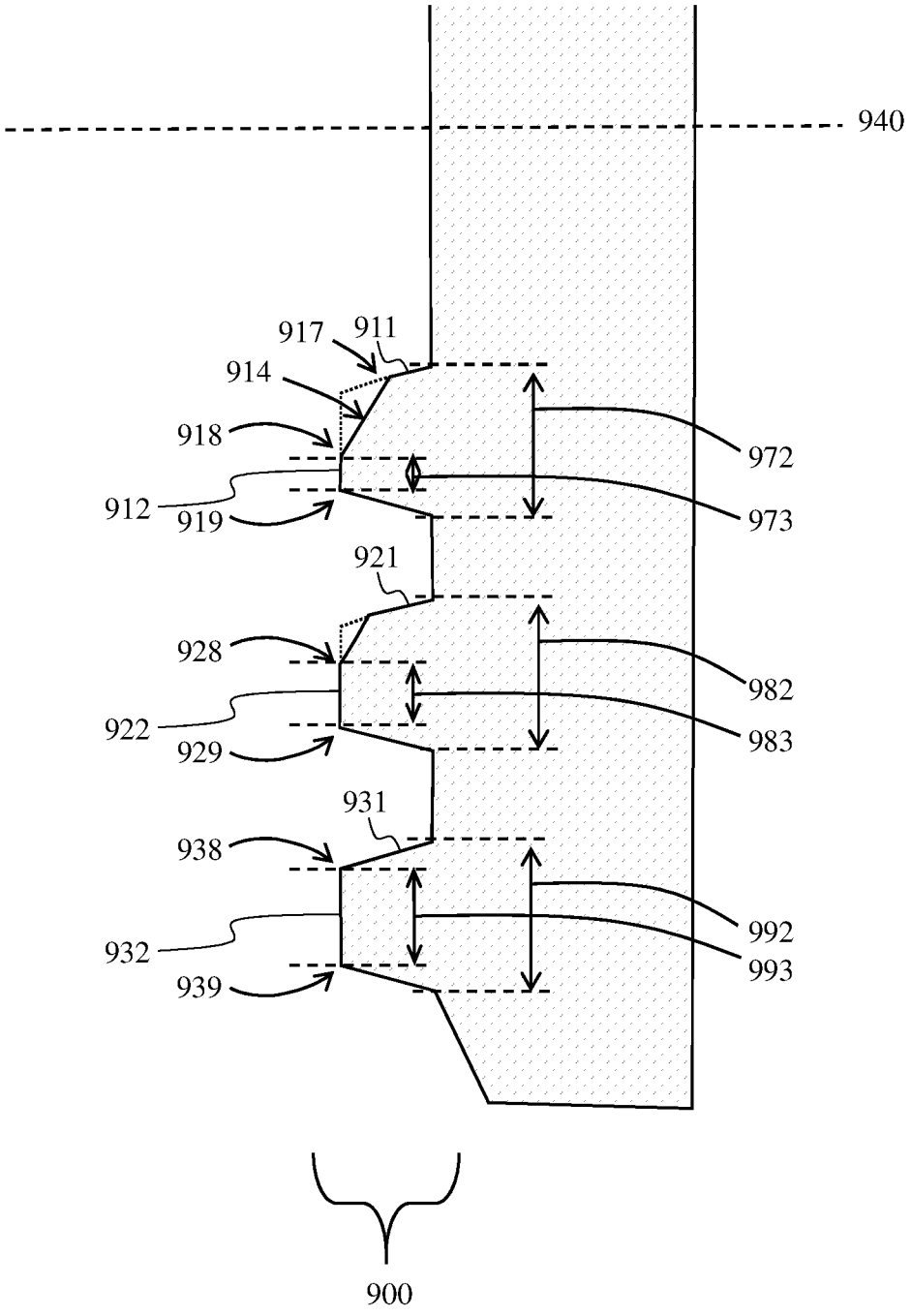
FIG. 15 shows a locking profile of a connector according to embodiments of the present disclosure.

FIG. 15 depicts one or more embodiments where the altered surfaces of the first and second teeth have a shape of a chamfer. The design of a first tooth 910 of the locking profile, closest to an axial center 940 of the connector, may be modified to include an altered surface 914 extending between an edge point 917 and a contact point 918 of the tooth 910. A thickness of the first tooth 972 may be measured from the from either sides of the base of the tooth (e.g., at the lowest point of the grooves formed on either sides of the tooth). A top surface length 973 may be measured between the contact point 918 and an end point 919. The top surface length 973 may be measured either as the shortest distance between the contact point 918 and the end point 919 or as the distance along the top surface 912 between the contact point 918 and the end point 919. The top surface length 973 may be less than 50%, 40%, 30%, 25%, 20%, 15%, 10%, 7%, 5%, 2.5%, or 1% of the thickness of the first tooth 972 measured at its base. It is also possible for the top surface length 973 to equal approximately zero, possibly because the contact point 918 and the end point 919 are collocated.

Similarly, a second tooth 920 of a locking profile may be modified to include an angled surface 924 extending between an edge point 927 and a contact point 928 of the tooth 920. A thickness of the second tooth 982 may be measured from the from either sides of the base of the tooth (e.g., at the lowest point of the grooves formed on either sides of the tooth). A top surface length 983 may be measured between the contact point 928 and an end point 929. The top surface length 983 may be measured either as the shortest distance between the contact point 928 and the end point 929 or as the distance along the top surface 922 between the contact point 928 and the end point 929. The top surface length 983 of the second tooth may be less than 50%, 40%, 30%, 25%, 20%, 15%, 10%, 7%, 5%, 2.5%, or 1% of the thickness of the second tooth 982 measured at its base. It is also possible for the top surface length 983 to be approximately equal to zero, possibly because the contact point 928 and the end point 929 are collocated. The top surface length of the first and second teeth 973, 983 may be equal. Alternatively, the top surface length of the second tooth 983 may be at least 1%, 2.5%, 5%, 7.5%, 10%, 15%, 20%, 25%, 30%, 50%, 75%, 100%, 150%, 200%, 250%, 300%, 500% or more greater than the top surface length of the first tooth 973.

The third tooth 930 may lack an edge point and an altered surface. A thickness of the third tooth 992 may be measured from the from either sides of the base of the tooth (e.g., at the lowest point of the grooves formed on either sides of the tooth). A top surface length 993 may be measured between the contact point 938 and an end point 939. It is also possible for the top surface length 993 to be approximately equal to zero, possibly because the contact point 938 and the end point 939 are collocated, such as may occur if a tooth has a largely triangular cross-sectional shape. The top surface length 993 may be less than 50%, 40%, 30%, 25%, 20%, 15%, 10%, 7%, 5%, 2.5%, or 1% of the thickness of the first tooth 992 measured at its base. In some embodiments, comparing the tooth base thickness with the top surface length, the third tooth may have a base thickness to top surface length ratio ranging from 50% to 95% while the first and second tooth may have a base thickness to top surface length ratio ranging from 3% to 80%, for example, 5% to 50%, or 10% to 30%. Finally, one having skill in the art will also readily see that there are reasons the tooth base thickness and/or the top surface length may be altered other than the addition of an altered surface.

Figure 16:
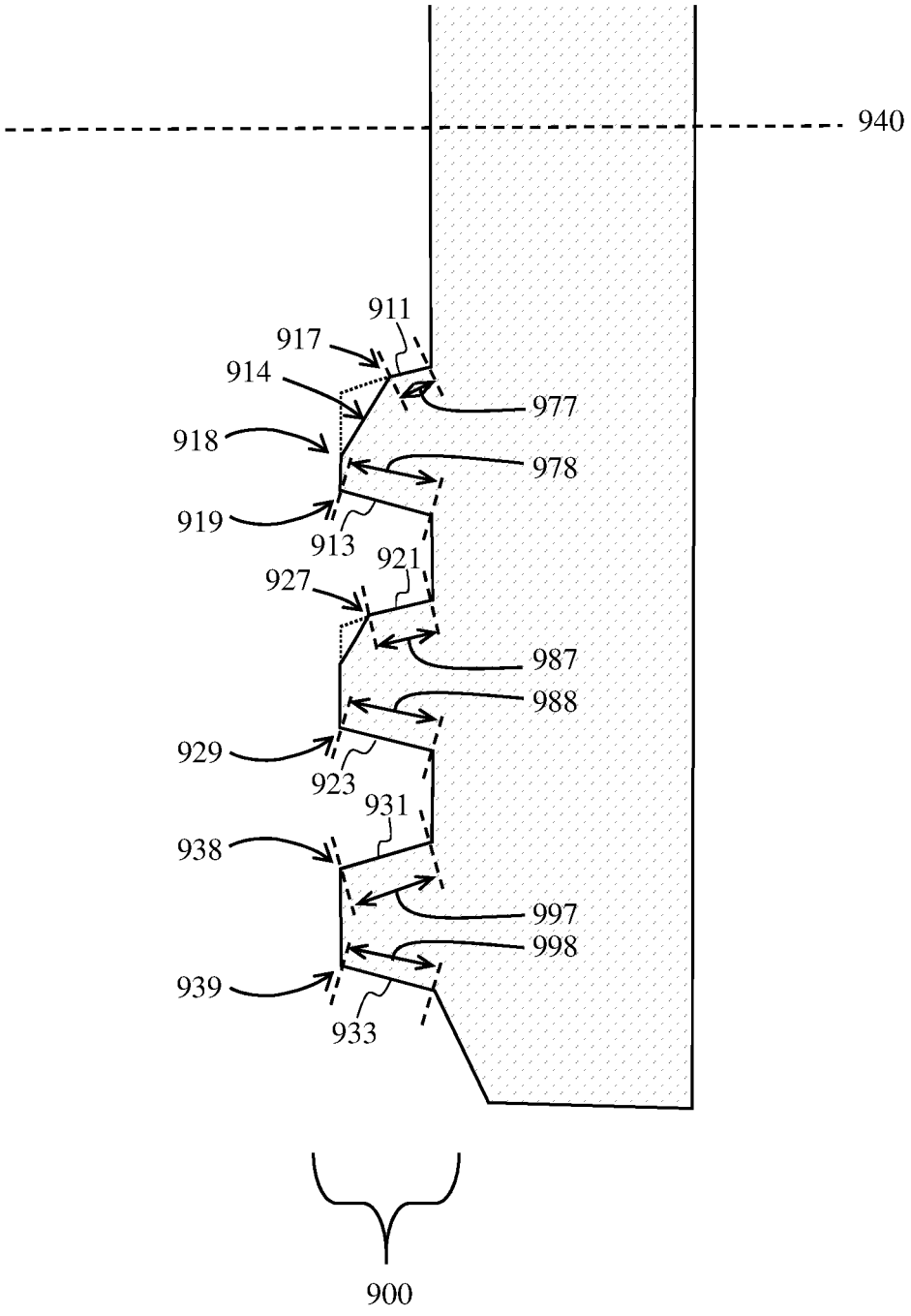
FIG. 16 shows a locking profile of a connector according to embodiments of the present disclosure.

FIG. 16 depicts one or more embodiments where the altered surfaces of the first and second teeth have a shape of a chamfer. The design of a first tooth 910 of the locking profile, closest to an axial center 940 of the connector, may be modified to include an altered surface 914 extending between an edge point 917 and a contact point 918 of the tooth 910. An engagement surface length 977 and a trailing side length 978 for the first tooth 910 may be measured. The engagement surface length 977 may be measured from the base of the tooth to the edge point 917. The engagement surface length 977 may be measured either as the shortest distance between the two points or as the length along the surface itself. Similarly, the trailing side length 978 is measured between an end point 919 and the base of the tooth. The trailing side length 978 may be measured either as the shortest distance between the two points or as the length along the surface itself. The engagement surface length 977 may be less than 90%, 75%, 50%, 40%, 30%, 25%, 20%, 15%, 10%, 7%, 5%, 2.5%, or 1% of the trailing side length 978 of the first tooth.

Similarly, a second tooth 920 of a locking profile may be modified to include an angled surface 924 extending between an edge point 927 and a contact point 928 of the tooth 920. An engagement surface length 987 and a trailing side length 988 for the second tooth 920 may be measured. The engagement surface length 987 may be measured from the base of the tooth to the edge point 927. The engagement surface length 987 may be measured either as the shortest distance between the two points or as the length along the surface itself. Similarly, the trailing side length 988 is measured between an end point 929 and the base of the tooth. The trailing side length 988 may be measured either as the shortest distance between the two points or as the length along the surface itself. The engagement surface length 987 may be less than 90%, 75%, 50%, 40%, 30%, 25%, 20%, 15%, 10%, 7%, 5%, 2.5%, or 1% of the trailing side length 988 of the second tooth. The engagement surface length of the first and second teeth 977, 987 may be equal. Alternatively, the engagement surface length of the second tooth 987 may be at least 1%, 2.5%, 5%, 7.5%, 10%, 15%, 20%, 25%, 30%, 50%, 75%, 100%, 150%, 200%, 250%, 300%, 500% or more greater than the engagement surface length of the first tooth 978.

The third tooth 930 may lack an edge point and an altered surface. An engagement surface length 997 and a trailing side length 998 for the third tooth 930 may be measured. Furthermore, the engagement surface length 997 and a trailing side length 998 may be equal. The engagement surface length of the third tooth 997 may be at least 1%, 2.5%, 5%, 7.5%, 10%, 15%, 20%, 25%, 30%, 50%, 75%, 100%, 150%, 200%, 250%, 300%, 500% or more greater than the engagement surface length of the first and/or second teeth 978, 988. Finally, one having skill in the art will also readily see that there are reasons the engagement surface length and/or the trailing side length may be altered other than the addition of an altered surface.

Figure 17:
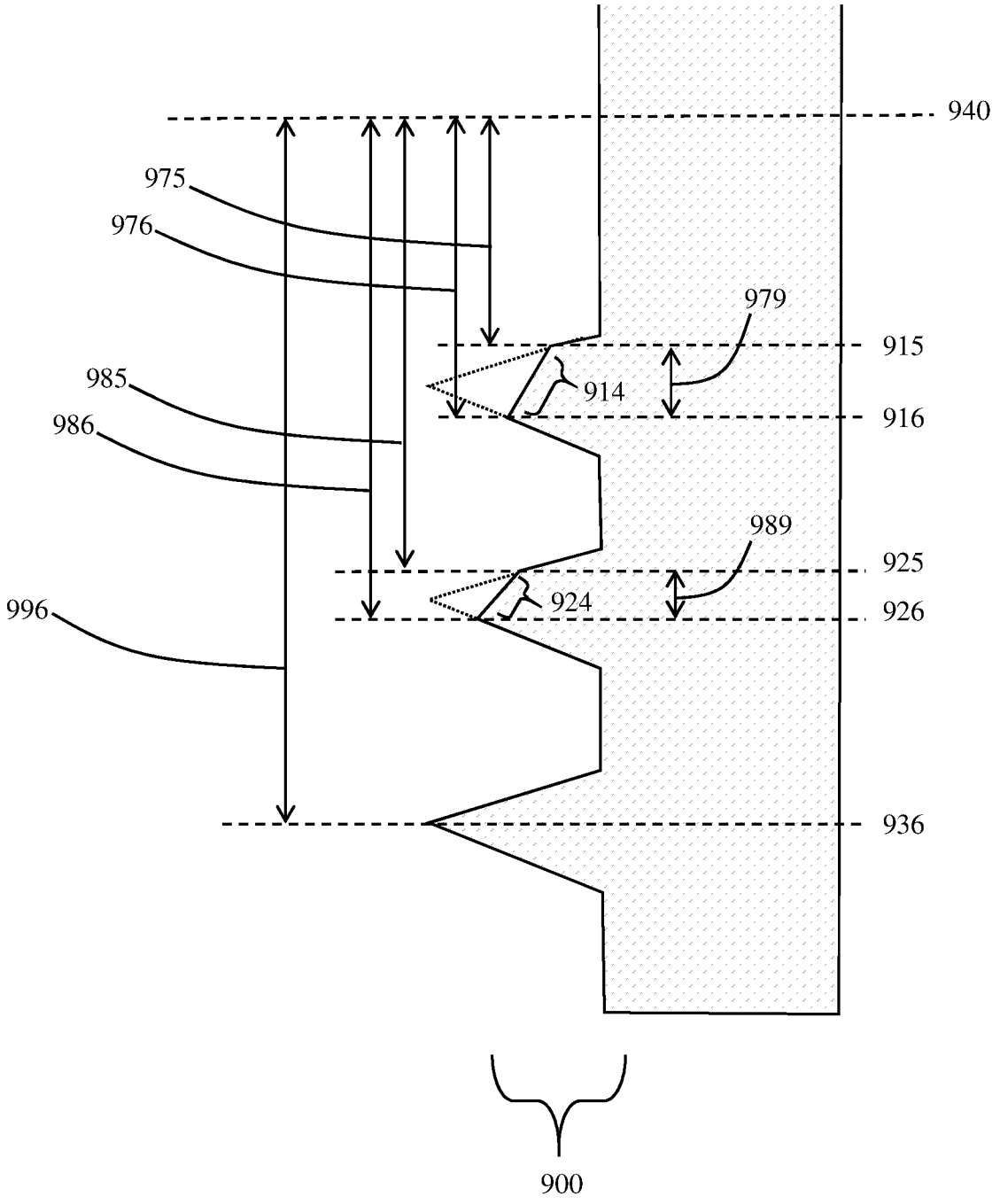
FIG. 17 shows a locking profile of a connector according to embodiments of the present disclosure.

FIG. 17 shows where some of the key features would be located and/or measured in one or more embodiments where the teeth are approximately triangular in cross-sectional shape. Thus, FIG. 17 depicts one or more embodiments where the altered surfaces of the first and second teeth have a shape of a truncated triangle. In embodiments according to this figure, the top surface length 973, 983, 993 are approximately equal to zero because the contact points 918, 928, 938 and the end points 919, 929, 939 are collocated. Thus, some measurements discussed above, such as the axial contact distances 979, 989, axial distances 975, 985, contact distances 976, 986, axial lengths, engagement surface lengths, etc. are relevant, while others may not be.

The different methods of quantifying an altered surface discussed herein may be used individually or in combination to describe modified tooth profiles according to embodiments of the present disclosure. For example, the geometry of an altered surface of a tooth according to embodiments of the present disclosure may be quantified by one or more of its axial contact separation, altered surface height, altered surface length, top surface length, base thickness to top surface length ratio, and/or engagement surface length.

Other examples of connecting assembly components having different sizes, shapes, numbers of teeth, tooth angles, types of hydraulic actuators, locking systems, etc. as disclosed herein may be used in combination with modified tooth design disclosed herein to improve the performance and mechanical advantage of the connecting assembly.

As used herein, mechanical advantage is the ratio of the generated connector preload to the external applied force. When the connecting assembly is hydraulically operated, the higher the required applied force, the higher the hydraulic pressure is required. The force required to generate a given preload may be decreased by increasing the mechanical advantage.

Generally, a higher mechanical advantage may be achieved by having a shallower angle on the teeth locking profile, which may transmit more axial force and less radial force. The downside of this design is that it may be harder to interface the tooth with a corresponding groove due to the shallower angle, thereby making the capture of the locking profile more difficult during the locking procedure.

By successfully interfacing with a high mechanical advantage design, a connecting assembly may require less hydraulic pressure to operate and therefore the size, weight, and cost of the connecting assembly can be reduced.

The present disclosure describes a design for the teeth in a connecting assembly that may provide easier capture of the connecting assembly, particularly for connecting assemblies with a low profile, a high preload, and a high gasket standoff. Such connecting assemblies can be smaller, lighter, and thus less costly for a given performance requirement.

Embodiments of the present disclosure may provide a connecting assembly, notedly for connecting components to a wellhead in oil production and extraction operations, particularly in the seabed, solving advantageously the technical inconvenient and economic disadvantages indicated above.

The figures described herein, and particularly FIGS. 9-17, are depicted schematically and are not drawn to scale. In fact, in order to more clearly highlight the feature(s) of interest, some of the figures may schematically depict embodiments with exaggerated measurements, such as in the depictions of relative length and/or angle.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A connecting assembly for connecting a first body and a second body, comprising:

a connector having a plurality of segments, the connector comprising:

a channel that extends longitudinally through the connector from a first end to a second end;

a plurality of teeth formed on an inside of the connector near the first end and near the second end, each tooth having a leading side facing an axial center of the connector, a top side, a contact point at a transition between the leading side and the top side, and a trailing side opposite the leading side;

a first jaw formed of at least one tooth of the plurality of teeth near the first end; and a second jaw formed of at least one tooth of the plurality of teeth near the second end and axially spaced apart from the first jaw;

wherein the at least one tooth of the second jaw comprises:

a first tooth axially closer to the axial center of the connector than the remaining teeth of the second jaw, wherein the leading side of the first tooth comprises an altered surface, an engagement surface, and an edge point at a transition between the altered surface and the engagement surface; and an end tooth axially farther from the axial center of the connector than the remaining teeth of the second jaw, wherein, if the second jaw only has one tooth, the first tooth will also be the end tooth;

a main piston positioned around at least a portion of the connector, wherein, when the main piston is in an unlocked position, at least one of the first or second ends of the connector is in a disconnected position, wherein, when the main piston is in a locked position, both the first end and the second end of the connector are in a connected position, wherein, for each of the plurality of teeth having the altered surface, a contact distance is measured axially between the contact point and the axial center; an edge distance is measured axially between the edge point and the axial center; and an axial contact separation is the contact distance minus the edge distance, wherein, for each of the plurality of teeth lacking an altered surface, the axial contact separation is equal to zero, wherein the at least one tooth of the second jaw further comprises a second tooth adjacent the first tooth, wherein a leading side of the second tooth comprises an altered surface, an engagement surface, and an edge point at a transition between the altered surface and the engagement surface, and wherein the altered surface of the first and the second teeth is an angled surface, and wherein a slope of the angled surface of the first tooth is greater than or equal to a slope of the angled surface of the second tooth.

2. The connecting assembly according to claim 1, wherein the axial contact separation of the first tooth is greater than zero.

3. The connecting assembly according to claim 1, wherein an axial contact separation of the first tooth is greater than an axial contact separation of the second tooth.

4. The connecting assembly according to claim 1, wherein the at least one tooth of the second jaw further comprises a third tooth adjacent the second tooth, wherein the leading side of the third tooth comprises an altered surface, an engagement surface, and an edge point at a transition between the altered surface and the engagement surface.

5. The connecting assembly according to claim 1, wherein the first jaw has a first locking profile that corresponds in shape with a first receiving profile on an outside of the first body.

6. The connecting assembly according to claim 1, further comprising a hydraulic actuator in communication with the main piston to axially move the main piston around the connector.

7. The connecting assembly according to claim 1, further comprising a gasket between the first body and the second body, wherein a gasket standoff is axially measured between a first end of the first body and a second end of the second body when at least one end of the connector is in the disconnected position.

8. The connecting assembly according to claim 1, wherein the second jaw has a second locking profile that is different in shape from a second receiving profile formed in an outside of the second body, and wherein the second locking profile has a shape that fits within and interlocks with the second receiving profile.

9. The connecting assembly of claim 1, wherein the second body is a wellhead.

10. The connecting assembly of claim 2, wherein the axial contact separation of the first tooth is greater than an axial contact separation of another tooth having an altered surface in the same jaw.

11. The connecting assembly of claim 1, wherein a shape of the altered surface of the first tooth comprises one of an angled surface, an elliptical surface, a curved surface, a bevel, a chamfer, a fillet, and a compound radius surface.

12. A method for connecting a first body and a second body, comprising:

connecting a connecting assembly comprising a connector and a main piston to a first axial end of the first body;

wherein a first end of the connector is in a connected position, the connected position including a first locking profile formed on the first end engaging a first receiving profile formed on the first axial end, wherein a second end of the connector is in a disconnected position;

positioning the first body so the first axial end interfaces a second axial end of the second body and so the second end of the connector is adjacent to the second axial end;

translating the main piston from an unlocked position to a locked position, wherein the second end of the connector converts to the connected position;

capturing at least a first groove of a second receiving profile formed on the second axial end with a first tooth of a second locking profile formed on the second end of the connector, the first tooth having a first altered surface formed along a leading side of the first tooth;

holding both the first end and the second end of the connector in the connected position to interlock the first locking profile with the first receiving profile and to interlock the second locking profile with the second receiving profile; and sequentially engaging teeth of the second locking profile to the second receiving profile such that the first tooth fully engages the first groove before a second tooth of the second locking profile having a second altered surface fully engages a second groove in the second receiving profile, wherein the altered surface of the first and the second teeth is an angled surface, and wherein a slope of the angled surface of the first tooth is greater than or equal to a slope of the angled surface of the second tooth.

13. The method according to claim 12, wherein a third tooth in the second locking profile fully engages a third groove in the second receiving profile after the second tooth fully engages the second groove.

14. The method according to claim 12, further comprising securing the main piston to prevent the main piston from translating out of the locked position.

15. The method of claim 12, wherein the connecting assembly is connected to the first body at an off-site location.

16. A connector, comprising:

a plurality of segments arranged in a tubular configuration having a first end and a second end;

a first jaw near the first end, the first jaw comprising at least one tooth formed on an inside of the plurality of segments and having a first locking profile; and a second jaw near the second end, axially spaced apart from the first jaw, the second jaw comprising at least one tooth formed on the inside of the plurality of segments and having a second locking profile, the at least one tooth of the second jaw comprising:

a first tooth axially closer to an axial center of the connector than the remaining teeth of the second jaw; and an end tooth axially farther from the axial center of the connector than the remaining teeth of the second jaw, wherein, if the second jaw only has one tooth, the first tooth will also be the end tooth;

wherein the first tooth has a first altered surface formed at a leading side of the first tooth;

wherein, for each of the at least one tooth having an altered surface, a contact point is at an end of the altered surface farthest from the axial center; an edge point is at an end of the altered surface closest to the axial center; a contact distance is measured between the contact point and the axial center; an edge distance is measured between the edge point and the axial center; and an axial contact separation is equal to the contact distance minus the edge distance; and wherein, for each of the at least one tooth lacking an altered surface, the axial contact separation is equal to zero, wherein a second tooth of the second jaw has a second altered surface, and wherein the altered surface of the first and the second teeth is an angled surface, and wherein a slope of the angled surface of the first tooth is greater than or equal to a slope of the angled surface of the second tooth.

17. The connector according to claim 16, wherein an axial contact separation of the first tooth is greater than an axial contact separation of the second tooth.

18. The connector according to claim 17, wherein a third tooth of the second jaw has a third altered surface, and wherein an axial contact separation of the first tooth is greater than an axial contact separation of the second tooth, and wherein the axial contact separation of the second tooth is greater than an axial contact separation of the third tooth.

* * * * *